US010478659B2

(12) United States Patent
O'Connor

(10) Patent No.: US 10,478,659 B2
(45) Date of Patent: Nov. 19, 2019

(54) DYNAMICALLY VARIABLE RADIUS CAM FOR WEIGHT LIFTING APPARATUS

(71) Applicant: Christopher S. O'Connor, Livonia, MI (US)

(72) Inventor: Christopher S. O'Connor, Livonia, MI (US)

( * ) Notice: Subject to any disclaimer, the term of this patent is extended or adjusted under 35 U.S.C. 154(b) by 109 days.

(21) Appl. No.: 15/796,039

(22) Filed: Oct. 27, 2017

(65) Prior Publication Data

US 2019/0126090 A1 May 2, 2019

(51) Int. Cl.
*A63B 21/00* (2006.01)
*A63B 24/00* (2006.01)
(Continued)

(52) U.S. Cl.
CPC ..... *A63B 21/155* (2013.01); *A63B 21/063* (2015.10); *A63B 21/159* (2013.01); *A63B 21/22* (2013.01); *A63B 21/4035* (2015.10); *A63B 23/1281* (2013.01); *A63B 24/0087* (2013.01); *A63B 21/06* (2013.01); *A63B 21/062* (2013.01); *A63B 21/0626* (2015.10);
(Continued)

(58) Field of Classification Search
CPC . A63B 21/155; A63B 21/4035; A63B 21/159; A63B 21/22; A63B 21/00058; A63B 21/00069; A63B 21/00076; A63B 21/00181; A63B 21/0083; A63B 21/0442; A63B 21/0085; A63B 21/0087; A63B 21/222; A63B 21/225; A63B 21/227; A63B 21/062; A63B 21/0626; A63B 21/0628; A63B 21/063; A63B 21/0632; A63B 23/1281; A63B 24/0087; A63B 2220/10; A63B 2220/16; A63B 2220/803; A63B 2208/0233; A63B 2208/833; A63B 2225/09; A63B 2225/096; E04H 17/063; B65F 2230/12; F24J 2/0427
USPC ..... 74/567, 569; 157/2; 194/223, 309, 335; 418/19–28; 449/2
See application file for complete search history.

(56) References Cited

U.S. PATENT DOCUMENTS 3,998,454 A 12/1976 Jones
4,354,676 A 10/1982 Ariel
(Continued)

FOREIGN PATENT DOCUMENTS

EP 0438758 A1 3/1991
EP 0857496 A2 8/1998

*Primary Examiner* — Andrew S Lo
*Assistant Examiner* — Zachary T Moore
(74) *Attorney, Agent, or Firm* — Brooks Kushman P.C.

(57) ABSTRACT

A variable radius cam mechanism is configured for use in a weight lifting apparatus. The variable radius cam mechanism includes a disk configured to rotate about an axis. The cam mechanism includes a cable guide coupled to the disk and defining a path for a cable and a radial tangent distance between the cable and the axis. The cam mechanism further includes one or more actuators coupled to the disk and the cable guide and configured to move the cable guide relative to the disk to change the radial tangent distance during rotation about the axis. The cam mechanism includes a controller programmed to operate the one or more actuators to cause the one or more actuators to move the cable guide to change the radial tangent distance thereby changing a force transferred through the cam mechanism.

20 Claims, 19 Drawing Sheets

(51) Int. Cl.

| | |
|---|---|
| ***A63B 21/062*** | (2006.01) |
| ***A63B 21/22*** | (2006.01) |
| ***A63B 23/12*** | (2006.01) |
| ***A63B 21/06*** | (2006.01) |

(52) U.S. Cl.
CPC ... *A63B 21/0628* (2015.10); *A63B 2208/0233* (2013.01); *A63B 2220/803* (2013.01); *A63B 2220/833* (2013.01)

(56) References Cited

U.S. PATENT DOCUMENTS

| | | | | |
|---|---|---|---|---|
| 4,544,154 | A | 10/1985 | Ariel | |
| 4,600,196 | A | 7/1986 | Jones | |
| 4,650,185 | A | 3/1987 | Cartwright | |
| 4,863,161 | A | 9/1989 | Telle | |
| 4,919,418 | A | 4/1990 | Miller | |
| 4,982,956 | A | 1/1991 | Lapcevic | |
| 5,344,374 | A | 9/1994 | Telle | |
| 5,356,360 | A | 10/1994 | Johns | |
| 5,387,170 | A | 2/1995 | Rawls et al. | |
| 5,624,353 | A | 4/1997 | Naidus | |
| 7,976,441 | B2 | 7/2011 | Ellis | |
| 8,360,935 | B2 | 1/2013 | Olsen et al. | |
| 9,272,179 | B2 | 3/2016 | Lemos et al. | |
| 2003/0092540 | A1 | 5/2003 | Gillen | |
| 2004/0254050 | A1 | 12/2004 | Morgan | |
| 2011/0034304 | A1* | 2/2011 | Kuo | A63B 21/155 482/97 |
| 2011/0165995 | A1 | 7/2011 | Paulus et al. | |
| 2014/0287876 | A1 | 9/2014 | Etter et al. | |
| 2017/0175886 | A1* | 6/2017 | Olson | F16H 9/18 |

* cited by examiner

DYNAMICALLY VARIABLE RADIUS CAM FOR WEIGHT LIFTING APPARATUS

TECHNICAL FIELD

This application generally relates to a cam mechanism with dynamically variable radius that can be used in a weight training apparatus for dynamically adaptive force adjustment.

BACKGROUND

Weight training systems allow a user to train various muscles in the body by providing a resistance against motion. A weight training system may be configured to isolate a particular muscle or set of muscles. For example, a weight training system may be designed to exercise arm muscles (e.g., biceps, triceps) or leg muscles. Weight training systems may utilize hydraulic, pneumatic, spring, or brake systems to provide the resistance. Some systems may provide effective resistance during the lift but not during the release portion of the cycle.

Some weight training systems utilize a complicated set of pulleys and cables coupled to one or more weights to provide the resistance. Such systems may improve the feel of the workout, but the complexity and number of moving parts makes assembly and maintenance difficult.

SUMMARY

A cam mechanism includes a disk configured to rotate about an axis and a cable guide coupled to the disk and defining a path for a cable and a radial tangent distance between the cable and the axis. The cam mechanism further includes one or more actuators coupled to the disk and the cable guide and configured to move the cable guide relative to the disk to change the radial tangent distance. The cam mechanism also includes a controller programmed to operate the one or more actuators to cause the one or more actuators to move the cable guide to change the radial tangent distance during rotation about the axis thereby changing a force transferred through the cam mechanism. The cam mechanism may further include a sensor configured to output a signal indicative of an angular position of the disk about the axis. The controller may be further programmed to operate the one or more actuators based on the signal.

A weight training apparatus includes a disk configured to rotate about an axis, a lift bar coupled to the disk and configured to rotate about the axis, and a cable guide coupled to the disk and defining a path for a cable and a radial tangent distance between the cable and the axis, wherein a first end of the cable is configured to couple to a weight stack and a second end is configured to attach to the cable guide. The weight training apparatus further includes one or more actuators coupling the disk to the cable guide and configured to move the cable guide relative to the disk to change the radial tangent distance. The weight training apparatus also includes a sensor configured to output a signal indicative of an angular position of the disk about the axis, and a controller programmed to operate the one or more actuators to cause the one or more actuators to move the cable guide based on the signal to change the radial tangent distance thereby changing a resistance force at the lift bar during rotation of the disk about the axis.

A weight training apparatus includes a disk configured to rotate about an axis and attach to a weight cable that is coupled to a weight stack and a cable guide that is coupled to the disk and configured to attach to a lift cable that is coupled to a force application member. The cable guide further defines a path for the lift cable and a radial tangent distance between the lift cable and the axis. The weight training apparatus includes one or more actuators coupled to the disk and the cable guide and configured to move the cable guide relative to the disk to change the radial tangent distance. The weight training apparatus also includes a sensor configured to output a signal indicative of an angular position of the disk about the axis and a controller programmed to operate the one or more actuators to cause the one or more actuators to move the cable guide based on the signal to change the radial tangent distance thereby changing a resistance force at the force application member during rotation of the disk about the axis.

In some configurations, the following features may be present. the cable guide may be coupled to the disk through a rotating pivot joint and operating the one or more actuators may cause the cable guide to pivot at the rotating pivot joint. The one or more actuators may include two actuators positioned on opposite sides of the disk and coupled together through an opening defined by the disk. The one or more actuators may include two actuators positioned on a same side of the disk and attached to the cable guide at different locations. The cable guide may be coupled to the disk by a sliding guide that constrains the cable guide to linear motion, and the sliding guide may include a first tube coupled to the disk and a second tube that is mounted concentric to the first tube and coupled to the cable guide. The cable guide may include a plurality of independent sections and each of the independent sections are coupled to the disk through a separate one of the one or more actuators.

DETAILED DESCRIPTION

Figure 1:
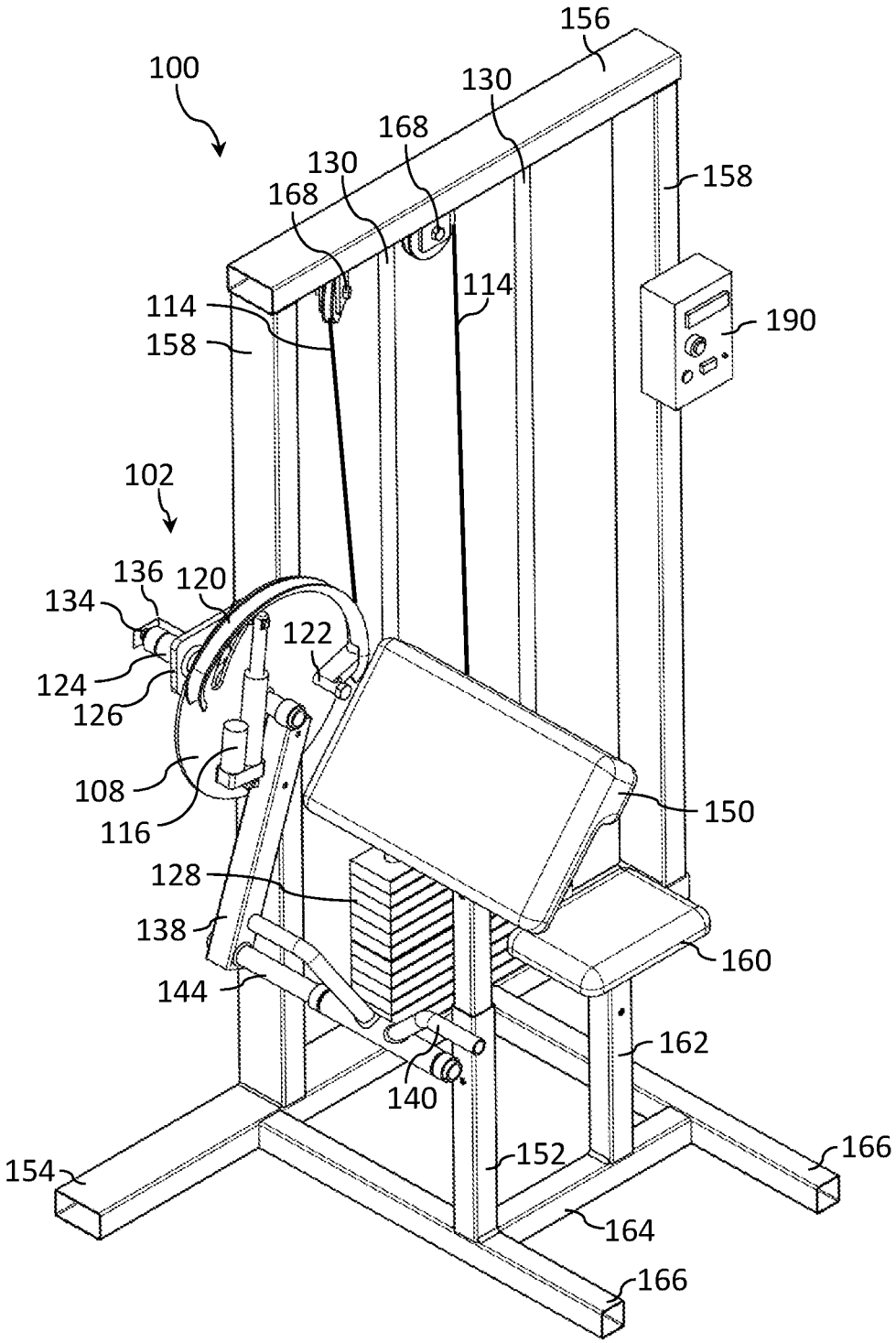
FIG. 1 is a front oblique view of a preacher arm curl apparatus at a bottom of a repetition and with a variable resistance cam in a maximum radius condition.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

A typical weight lifting apparatus may be configured to provide a constant resistance during exercise. However, the constant resistance may not provide the most effective workout for muscle development. An issue that may occur during a weight training session is the onset of muscle fatigue leading to a person being unable to complete a set of repetitions. It is commonly accepted that maximum muscle growth occurs during the last few repetitions of the set when the muscle is fully exhausted. The ability to vary the weight in real time during a set allows the user to continue deeper into the muscular exhaustion and growth. A person lifting weights may enlist the aid of a spotter (e.g., another person) to help lift or hold the weight when muscle fatigue sets in.

The weight training apparatus and system described herein can detect user fatigue and provide a spotter function to reduce the resistance when fatigue is detected. The system described herein can also vary the resistance during an exercises session to provide a more varied workout. The system may also be adapted to different weight training devices that may target different muscles.

The system herein is configured to provide an electronic feedback loop to automatically vary the resistance based on real-time measurements including speed of the lift, stall detection, total repetitions, force applied, and/or energy exerted. A common performance metric for weight trainers is the number of exercise cycles, iterations, or repetitions (or 'reps') expressed as a discrete integer. These discrete integer performance metrics make it difficult for the user to observe progress over a short term. For example, the number of exercise cycles does not consider the resistance level during the exercise cycle. The system described herein is also configured to calculate the average force and energy lifted over the set to provide a continuous performance metric. Such a continuous performance metric provides a better indication of progress than the number of exercise cycles.

Figure 2:
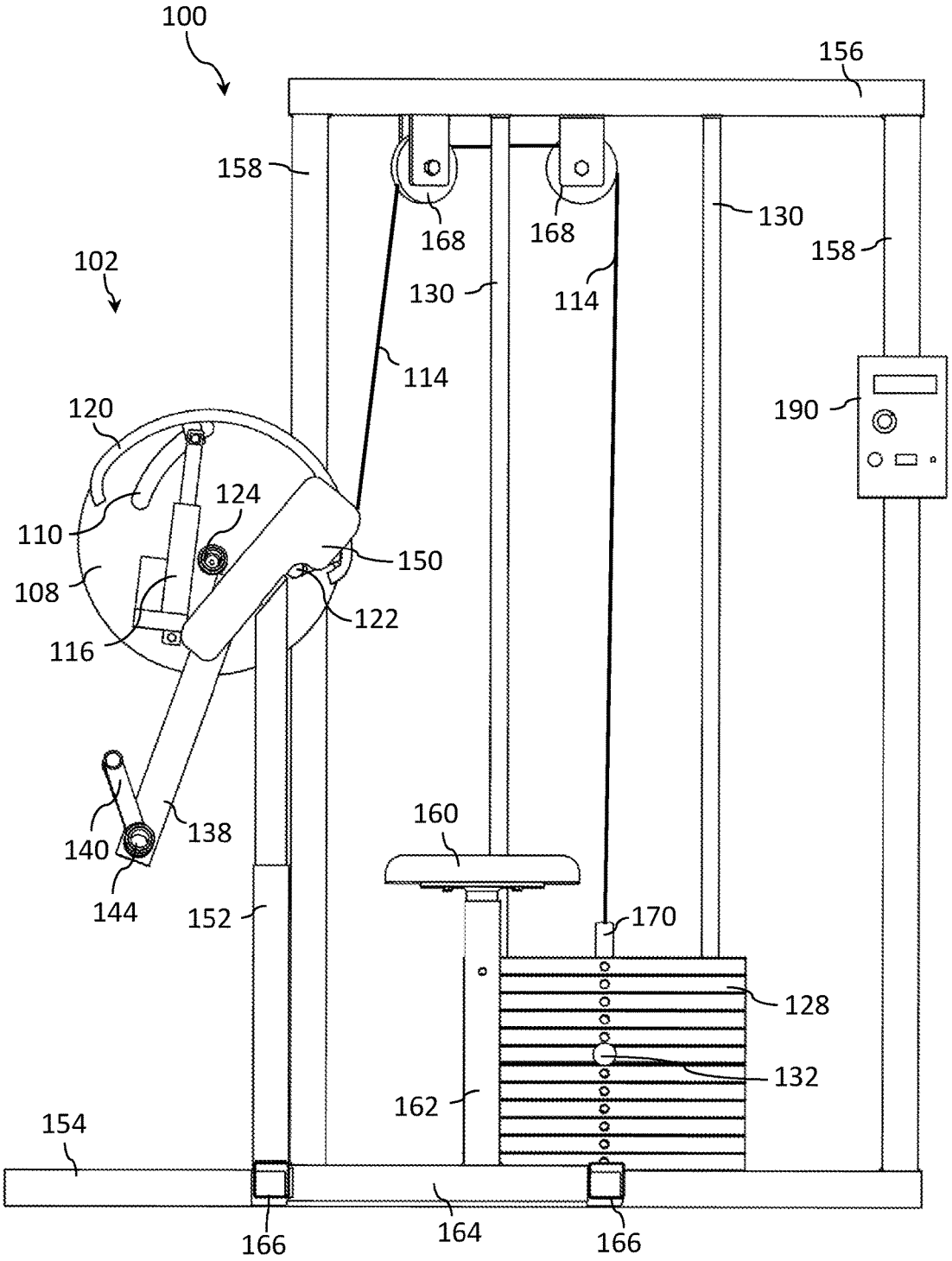
FIG. 2 is a side view of the preacher arm curl apparatus at a bottom of a repetition and with the variable resistance cam in the maximum radius condition.
Figure 3:
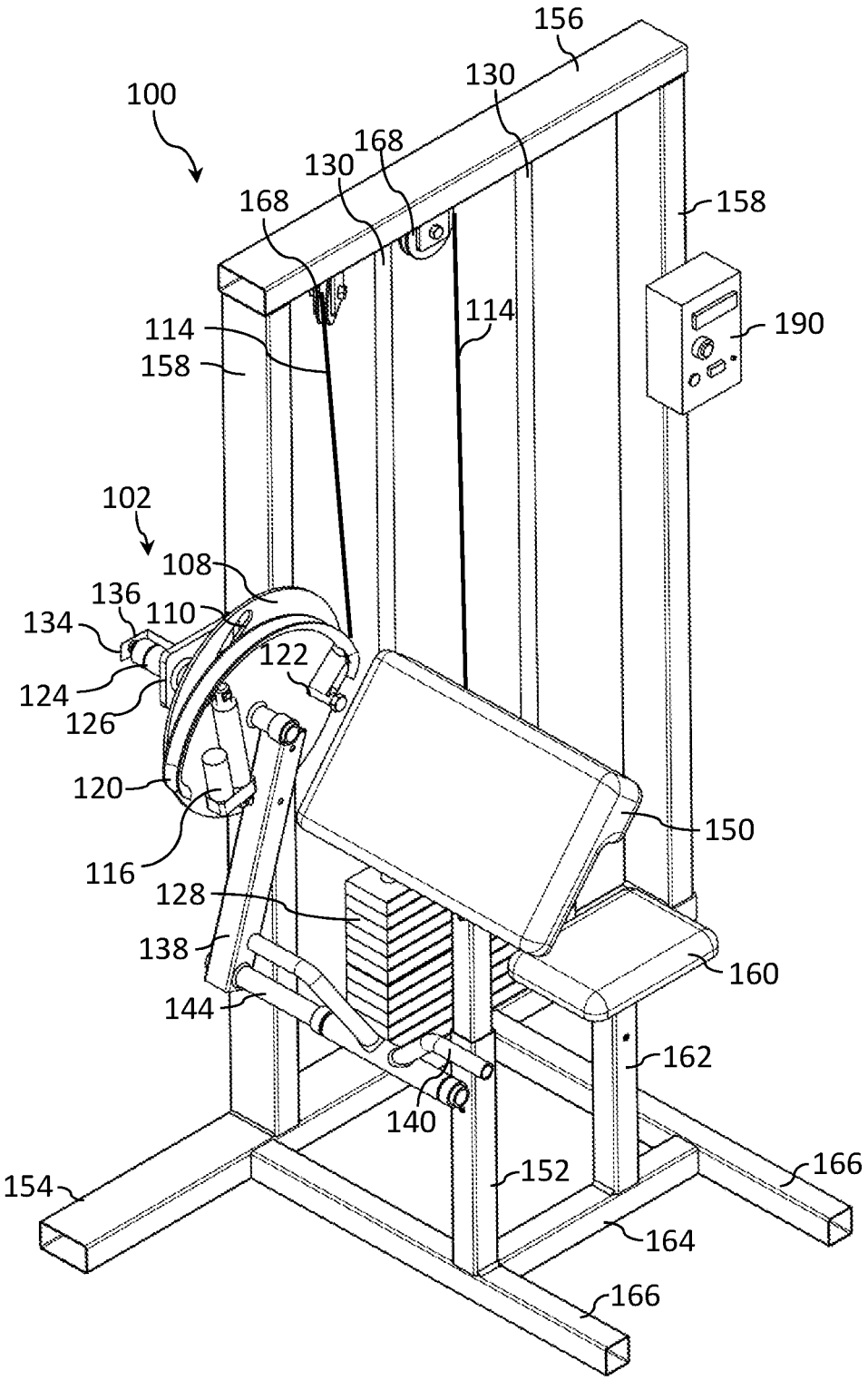
FIG. 3 is a front oblique view of the preacher arm curl apparatus at a bottom of a repetition and with the variable resistance cam in a reduced radius condition.
Figure 4:
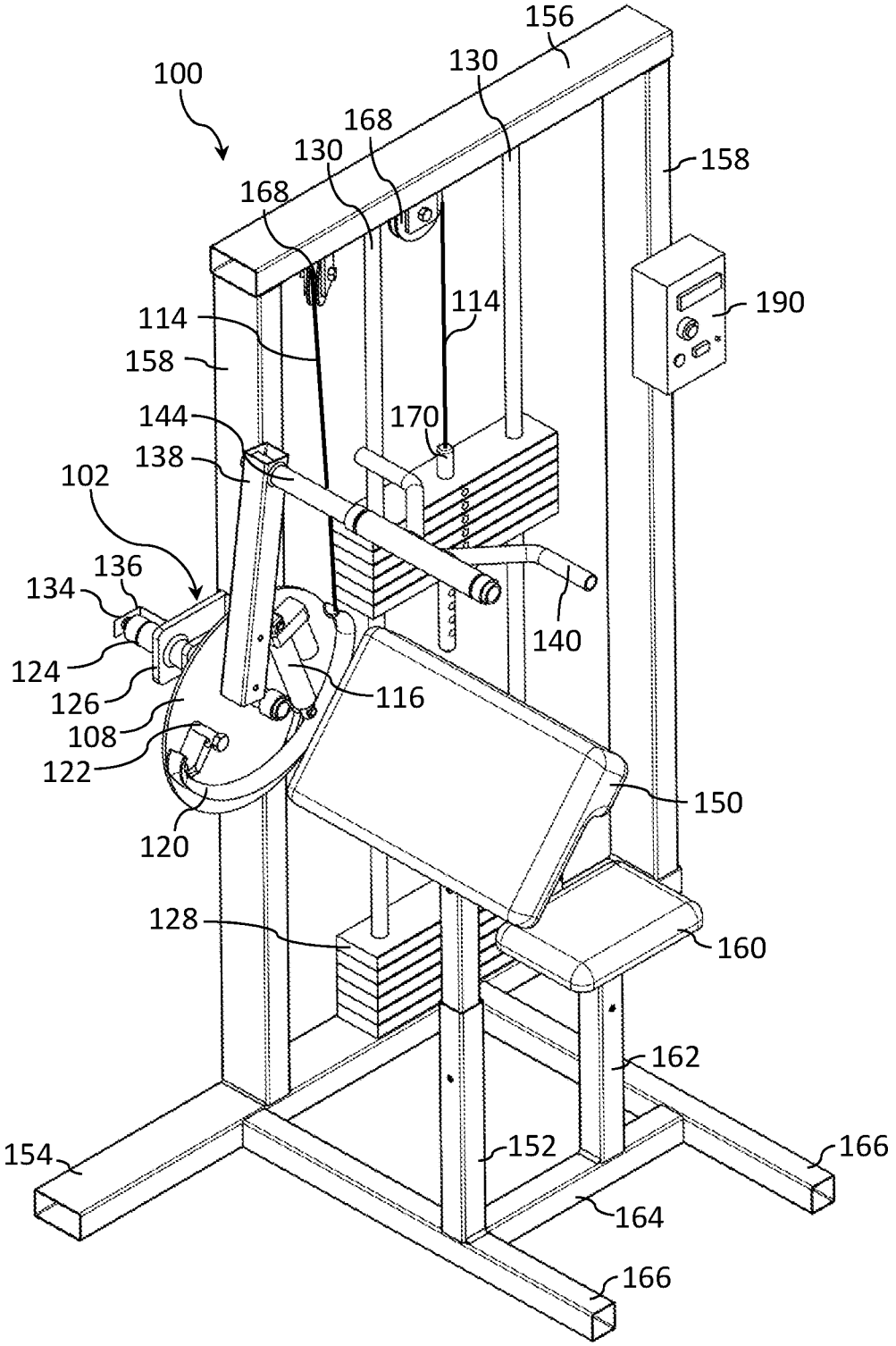
FIG. 4 is a front oblique view of a preacher arm curl apparatus at a top/lifted position of a repetition and with the variable resistance cam in a reduced radius condition.

FIGS. 1-4 depicts different views of one possible configuration of the dynamically variable radius cam weight machine or apparatus in the form of a preacher arm curl apparatus 100. The preacher arm curl apparatus 100 includes a variable resistance cam 102. FIGS. 1 and 2 depict views of the apparatus 100 at the bottom of a repetition or a resting state with the variable resistance cam 102 in a maximum radius or full load state. FIG. 3 depicts a view of the apparatus 100 at the bottom of a repetition or a resting state with the variable resistance cam 102 in a reduced radius or reduced load state. FIG. 4 depicts a view of the apparatus 100 at a top of a repetition with the variable resistance cam 102 in the reduced radius or reduced load state.

Referencing FIGS. 1-4, the variable resistance cam 102 may be comprised of a cam disk 108. The cam disk 108 may be coupled to a pivot axis tube 124. The pivot axis tube 124 may intersect the cam disk 108 at a perpendicular angle. A point of intersection of the pivot axis tube 124 and the cam disk 108 may be in a center of the cam disk 108. In some configurations, the point of intersection may be offset from the center of the cam disk 108 to provide a tailored resistance profile. The cam disk 108 may be configured to be rigidly attached to the pivot axis tube 124 and rotate with the pivot axis tube 124 about an axis of rotation. The pivot axis tube 124 may define the axis of rotation of the variable resistance cam 102 and a lift arm 138 that is coupled to the variable resistance cam 102. The lift arm 138 may be directly coupled to the cam disk 108. A user may cause the cam disk 108 to rotate by applying a force to the lift arm 138.

The arm curl apparatus 100 may further include various members that form a frame or structure for attachment of the various elements. The arm curl apparatus 100 may include one or more base support members 166. The base support members 166 may include adjustable feet at various locations to facilitate leveling of the arm curl apparatus 100. The base support members 166 depicted are generally parallel to one another and the depiction is not intended to limit the shape. Other configurations may be implemented. A base cross support member 154 may be coupled to the base support members 166 at a first end of the base support members 166.

The arm curl apparatus 100 may include a seat support base 164 that is coupled to the base support members 166. A first end of a seat support upright 162 may be coupled to the seat support base 164. A seat 160 may be coupled to a second end of the seat support upright 162. The seat 160 may be cushioned. In some configurations, the seat 160 and/or seat support upright 162 may be configured to provide a vertical and horizontal adjustment mechanism for the seat 160. The seat 160 may be supported vertically through the seat support upright 162. The seat support base 164 may include adjustable feet to facilitate leveling. Coupling of the seat support base 164 to the base support members 166 may be with bolts or welds.

The arm curl apparatus 100 may include an arm support upright 152 that is configured to support and hold an arm support pad 150. A first end of the arm support upright 152 may be coupled to the base support member 166. A second end, opposite the first end, of the arm support upright 152 may be coupled to the arm support pad 150. The arm support pad 150 may include a padded surface for the arms of the user to contact during exercise. For example, the arm support pad 150 may include a wood or metal substrate encased in padding material and a vinyl cover. The arm support upright 152 may be of adjustable height to facilitate positioning of the arm support pad 150.

The arm curl apparatus 100 may include one or more upright supports 158. The upright supports 158 may be coupled at a first end to the base cross support 154. At a second end, the upright supports 158 may be coupled to an upper cross support 156. The upper cross support 156 may span a distance across the upright supports 158. The upright supports 158 and the upper cross support 156 may form a frame that is configured to support a predetermined amount of weight. The upright supports 158, upper cross support 156 and the base cross support 154 may be configured to provide a frame structure for supporting a weight stack 128.

The weight stack 128 may include a plurality of weight elements or plates that are configured in a stack. Each of the weight elements may have a predetermined weight. The weight elements are not necessarily the same weight. The weight stack 128 may be configured to move in a generally vertical direction relative to the ground or floor surface. The weight stack 128 may be guided by one or more weight stack guides 130.

For example, the weight guides 130 may be a pair of poles coupled between the base cross support 154 and the upper cross support 156. The weight elements, and by association the weight stack 128, may be configured with openings at locations corresponding to a distance between the weight guides 130 (e.g., the pair of poles). The weight stack 128, when the pair of poles are received by the openings, is then constrained to move in a direction along the poles. The weight guides 130 may be installed in a generally vertical direction so that the weight elements are generally constrained to move in a generally vertical direction (e.g., up or down relative to the ground).

The weight stack 128 may include a weight selection mechanism 170 for adjusting the number of weighting elements that are coupled to a cable 114. For example, the weight selection mechanism 170 may be a member that is coupled at a first end to the cable 114. The weight selection mechanism 170 may be received by an opening in each of the weighting elements. For example, the weighting elements may define a central opening that is configured to receive the weight selection mechanism 170. The weighting elements may further define weight selection openings in a side surface that correspond to weight retention openings defined in the weight selection mechanism 170. When the weight selection mechanism 170 is received by the weight stack 128, the weight selection openings of the individual weighting elements may line up with the weight retention openings defined in the weight selection mechanism 170. For example, the weight stack 128 may be configured such that, in a rest position, the weight selection openings are aligned with the weight retentions openings. A pin 132 or other retaining device may be inserted in the desired weight selection opening. The pin 132 may pass through the selected weighting element and through the corresponding weight retention opening defined by the weight selection mechanism 170. The weighing elements that are above the selected weighing element may be lifted by motion of the cable 114. When the pin 132 is inserted, an active weight stack and an inactive weight stack are defined. The active weight stack includes the weighting elements that move when the cable 114 is moved. The inactive weight stack includes the weighing elements that are not moved or remain in the rest position when the cable 114 is moved.

The weight stack 128 may include a plurality of pulleys 168 that are coupled to the upper cross support 156. The pulleys may be configured to route the cable 114 from the weight stack 128 to the variable resistance cam 102. The result is that a force from the weight stack 128 is transferred through the cable 114 to the variable resistance cam 102. The variable resistance cam 102 is also compatible with other configurations of the frame and weight stack.

The pivot axis tube 124 may be supported by a pivot support member 126. The pivot support member 126 may be configured to receive the pivot axis tube 124 such that the pivot axis tube 124 may rotate relative to the pivot support member 126. The pivot support member 126 may include a tube in which the pivot axis tube 124 is concentrically coupled to allow for rotation of the pivot axis tube 124. The pivot support 126 may be attached to the upright support 158. The pivot support member 126 may include one or more bearings to facilitate motion of the pivot axis tube 124 relative to the pivot support member 126. The interface between the pivot axis tube 124 and the pivot support member 126 may include lubrication to reduce friction.

A cable guide 120 may be coupled to the cam disk 108 at a predetermined location of the cam disk 108. The cable guide 120 may be configured to rotate with the cam disk 108. A lift cable 114 may be attached to the cable guide 120 at an attachment position. The attachment position may be near an end of the cable guide 120. Along a surface in which the cable 114 is may be in contact with the cable guide 120, the cable guide 120 may be configured with edges to aid in maintaining the cable 114 along a path defined by the cable guide 120. For example, the cable guide 120 may have a rounded cross-section to provide a path along which the cable 114 may be routed. The cable guide 120 may have a generally circular profile that routes a cable 114 along a circular path about the cam disk 108. The cable guide 120 may implement a variety of profiles to vary an effective load resistance. That is, the cable guide 120 does not necessarily define a perfectly circular path. For example, the cable guide 120 may define an oval path. In other configurations, the cable guide 120 may define other shapes to achieve a desired resistance profile. The predetermined location at which the cable guide 120 is attached may also affect the effective load resistance.

The cable guide 120 may be attached to the cam disk 108 through a cable guide pivot 122 that defines a rotating pivot joint. The cable guide pivot 122 may be a rotational hinge joint. This allows the cable guide 120 to pivot about the cable guide pivot 122 to change the position of the cable guide 120 relative to the cam disk 108. Pivoting of the cable guide 120 may alter the path of the cable 114 relative to the cam disk 108. The location of the cable guide pivot 122 on the cam disk 108 may be varied in the design to achieve different resistance profiles.

The cable guide 120 may be displaced about the cable guide pivot 122 by one or more actuators 116 that may be attached to the cam disk 108. The one or more actuators 116 may be linear actuators. In some configurations, two actuators 116 may be used in parallel depending on the force requirements for moving the cable guide 120. The cam disk 108 may define an opening or cam window 110 that allows two actuators 116 to be mechanically connected through the cam disk 108. For example, an actuator 116 may be positioned on opposite sides of the cam disk 108. The actuators may be coupled by a pin that couples ends of the actuators 116 and passes through the cam window 110. At least one of the actuators 116 or the pin may be coupled to the cable guide 120. The cam window 110 may be configured to guide the cable guide 120 to a position as the actuators 116 are actuated. The actuator(s) 116 may be electrically coupled to an electronic control unit 190 through electrical cables. The electronic control unit 190 may execute the control logic to manage increases or decreases in the resistance. As the actuator(s) 116 are extended or retracted, the cable guide 120 moves with respect to the periphery of the cam disk 108. This movement varies the effective resistance that the user experiences through the lift arm 138.

The actuator 116 may include an electric motor powered by electrical energy. The actuator 116 may include a travel arm concentrically arranged with a fixed base. The travel arm may be configured to move relative to the fixed base. The fixed base may be rigidly coupled to the cam disk 108 or fixed to allow rotation about the attachment point. The electric motor may be DC motor in which a DC voltage is applied to cause rotation of the motor shaft. The electric motor may be operated by applying a voltage across terminals of the electric motor. The electric motor may be rotated in a first direction by applying a positive voltage across the terminals. The electric motor may be rotated in a second direction, opposite the first direction, by applying a negative voltage across the terminals. Generally, by reversing the polarity of the applied voltage, the direction of rotation changes. In other examples, a stepper motor, an induction motor, a permanent magnet (PM) motor or other type of motor may be utilized. Selection of a different type of electric motor may impact the selection of the electronics and controls to operate the electric motor.

The actuator 116 may include an associated rotational to translational motion conversion mechanism to convert rotational motion of the electric motor into translational motion of the travel arm. Examples may include a rack and pinion mechanism, a worm gear, a ball screw, a roller screw, or a leadscrew. Motion of the travel arm causes motion of the cable guide 120. For example, moving the travel arm may cause the cable guide 120 to pivot about the cable guide pivot 122. The electric motor may cause motion of the travel arm in a direction that extends and retracts the travel arm from and into the fixed base. For example, rotation of the electric motor shaft in a first direction (e.g., clockwise) may cause the travel arm to move in a first direction to increase a radial distance of the cable guide 120 from the pivot axis tube 124. Rotation of the electric motor shaft in a second direction opposite the first direction (e.g., counter-clockwise) may cause the travel arm to decrease the distance of the cable guide 120 from the pivot axis tube 124. Movement of the actuator 116 may change a radial distance between the cable guide 120 and the pivot axis tube 124. A variety of linear actuators are commercially available. For example, U.S. Pat. No. 9,506,542, herein incorporated by reference, depicts and describes a representative linear actuator that may be utilized in the present application. An example of a commercially available linear actuator is model number LA-01 from Tampa Motions Company for which the product specification is hereby incorporated by reference. A representative application may utilize the LA-01 with a stroke size of four inches.

The linear extension of the actuator 116 may be measured and/or estimated. For example, a sensor may be coupled to the extending portion of the actuator to provide a signal indicative of the amount of extension of the actuator 116. The signal may be used to measure and/or estimate the radial distance between the cable guide 220 and the pivot axis tube 124. In some configurations, the linear extension may be estimated by monitoring the activation of the actuator 116 For example, a magnitude and direction of current flowing to the actuator 116 and the amount time the current is applied may be used to estimate the linear motion.

A user may transfer force to the variable resistance cam 102 through a force application member. For example, a user may grip a rotatable lift handle 140 to begin a lift. The lift handle 140 may be coupled to a lift bar 144. The rotatable lift handle 140 may be attached to the lift bar 144 through a rotating joint so that the lift handle 140 may rotate about an axis defined by the lift bar 144. The lift bar 144 may be coupled to the lift arm 138. The force from the user may be transferred from the rotating lift handle 140 to the lift bar 144, and then to the lift arm 138, and then to the cam disk 108. The lift arm 138 may be rigidly mounted to the cam disk 108 or attached on a pivot with a selector pin.

An end of the cable 114 may be coupled to an end of the cable guide 120. The cable 114 may move radially into a groove or slot defined by the cable guide 120 as the rotating lift handle 140 is raised. The cable 114 may be routed to the weight plate stack 128 through one or more pulleys 168 that may be attached to the upper cross support member 156. The pulleys 168 may be configured to maintain an alignment of the cable 114 with the cable guide 120.

During the lift, the user may rest their arms on the arm support pad 150 that is supported by the arm support upright 152. Also, during the lift, the user may sit on the seat 160 that is supported by the seat support upright 162, which is attached to the seat support base 164. The user may then engage in an exercise cycle by raising and lowering the lift handle 140. The resistance to motion of the lift handle 140 may be a function of the length of the lift arm 138, the amount of weight of the weight stack, and the effective radius defined by the variable resistance cam 102.

An angular motion sensor 134 may be coupled to the pivot axis tube 124 to measure rotation of the cam disk 108. The angular motion sensor 134 may be aligned axially with the pivot axis tube 124 and may be configured to measure an instantaneous angle of the pivot axis tube 124 and transmit the signal to the electronic control unit 190. For example, a shaft of the angular motion sensor 134 may be coupled to the pivot axis tube 124. A mounting bracket 136 may be coupled to the pivot support member 126 via a fastener such as a bolt or screw to hold the non-rotating portion of the angular motion sensor 134. As the pivot axis tube 124 rotates, the shaft of the angular motion sensor 134 rotates to vary an output signal that is indicative of the angle of rotation (e.g., angular position of the cam disk 108). Angular motion sensor wires are used to electrically couple the angular motion sensor 134 to a control device.

The angular motion sensor 134 may be a rotary potentiometer. In some configurations, the angular motion sensor 134 may be an encoder or resolver. Any sensor configured to measure an angular position may be utilized. In some configurations, the angular motion sensor 134 may be an accelerometer that is mounted on the cam disk 108 to provide a signal indicative of the angle of rotation of the cam disk 108. The accelerometer may be configured to measure the component of acceleration due to gravity that is perpendicular to the accelerometer mounted to the cam disk 108. As the angle of rotation changes, the force due to gravity in the perpendicular direction changes. The signal may be monitored and processed by a controller to generate an estimate of the angle of rotation of the lift arm 138.

The output of the angular motion sensor 134 provides a signal indicative of the angular position of the cam disk 108. The angular position may be an angle relative to the resting position and may be referred to as a lift angle. Further, a speed of rotation may also be derived from the position signal. By differentiating the position signal an angular velocity of the cam disk 108 may be computed. In addition, a derivative of the angular velocity provides an angular acceleration of the cam disk 108. The position, velocity, and acceleration values may be used to control operation of the linear actuator 116. The control device 190 receiving the output signal of the angular motion sensor 134 may be programmed to compute the angular position, angular velocity, and angular acceleration values. A starting position of a repetition may be a position that is greater than the resting position of the cam disk 108. Learning a starting position may begin when the angular position changes from the resting position of the cam disk 108. For some configurations, the starting position of the repetition may be the same as the resting position of the cam disk 108. An alternative method of estimating the angular velocity of the cam disk 108, without the noise inherent in numerical differentiation, is to monitor the angular displacement over a fixed time interval to determine if the angular velocity exceeds a predetermined threshold.

For example, when the angular motion sensor 134 is a rotary potentiometer, the electrical resistance of the potentiometer varies as the pivot axis tube 124 rotates. The resistance value may be indicative of the relative angle of the cam disk 108 from the rest position. The rest position may be the position in which the cam disk 108 is in a position in which the weight stack 128 is resting. By measuring the resistance value, the angle of the cam disk 108 may be determined. A calibration procedure may be utilized to calibrate the resistance values for a given range of angles. The rotary potentiometer may have three electrical connections. A predetermined voltage may be applied across first and second electrical connections. An output signal may be provided by the third electrical connection that has a voltage that varies as the resistance changes during rotation. The output signal may be input to the control device.

The lift angle may be measured based on the angle at a bottom-most position when the weight stack 128 is at rest. The base or minimum lift angle may be calibrated as zero degrees. The lift angles computed during an exercise cycle or repetition may be relative to the base lift angle. The angle between the base angle and the various positions of the cam disk 108 may be estimated or determined via calibration. An exercise cycle may begin with the weight stack 128 at the bottom-most position/angle. As the lift bar 144 is raised, the weight stack 128 will move toward a top-most position/angle. During this interval, the lift angle should be increasing. That is, a present lift angle measurement should be greater than a previous lift angle measurement. Alternatively, the angular velocity should be a positive value. As the lift bar 144 is lowered, the weight stack 128 will move toward the bottom-most position/angle. During this interval, the lift angle should be decreasing. That is, a present lift angle measurement should be less than a previous lift angle measurement. Alternatively, the angular velocity should be a negative value.

The arm curl apparatus 100 provides a resistance to motion that depends on various factors. The weight of the weight plates 128 coupled to the cable guide 120 affects the resistance. Further, the cable guide 120 can be rotated to change the effective radius of the variable resistance cam 102. The resistance may further depend on the length of the lift arm 138. The resistance further depends on the radial distance from the pivot axis tube 124 at which the cable 114 contacts the cable guide 120, referred to as the radial tangent distance. For example, the resistance torque is the product of the radial tangent distance defined by the position of the cable guide 120 and the weight of the weight stack 128. The radial tangent distance may be measured from the axis defined by the pivot axis tube 124.

The user may apply a force on the lift bar 144 that is directed to the lift arm 138 which may cause the cam disk 108 to rotate. In order to rotate the cam disk 108, a force greater than the resistance force defined in part by the weight stack 128 must be generated by the user. The torque needed may be the product of the weight and the radial tangent distance defined by the position of the cable guide 120. Note that if the radial tangent distance remains constant, a constant resistance may be present.

The cable guide 120 may be displaced or moved by the actuator 116 which changes the effective radius of the cam disk 108. The effective resistance may be a function of the radial tangent distance from the pivot axis defined by the pivot axis tube 124 and the point at which the lift cable 114 intersects the cable guide 120. By operating the actuator 116, the radial tangent distance may be varied which causes a change in the torque resistance at the lift bar 144. Differing the location of the cable guide pivot 122 with respect to the pivot axis tube 124 allows a variety of resistance profiles to be achieved.

During an exercise cycle, the control unit 190 may operate the actuator 116 to vary the radius of the variable resistance cam 102. The control unit 190 may be programmed to vary the radius to achieve a particular torque profile. Operation of the actuator 116 may be according to the lift angle measured by the angular position sensor 134. The radial tangent distance may be a function of the lift angle. In this manner, the resistance may be modified during a lift to achieve a predetermined torque profile.

Figure 5:
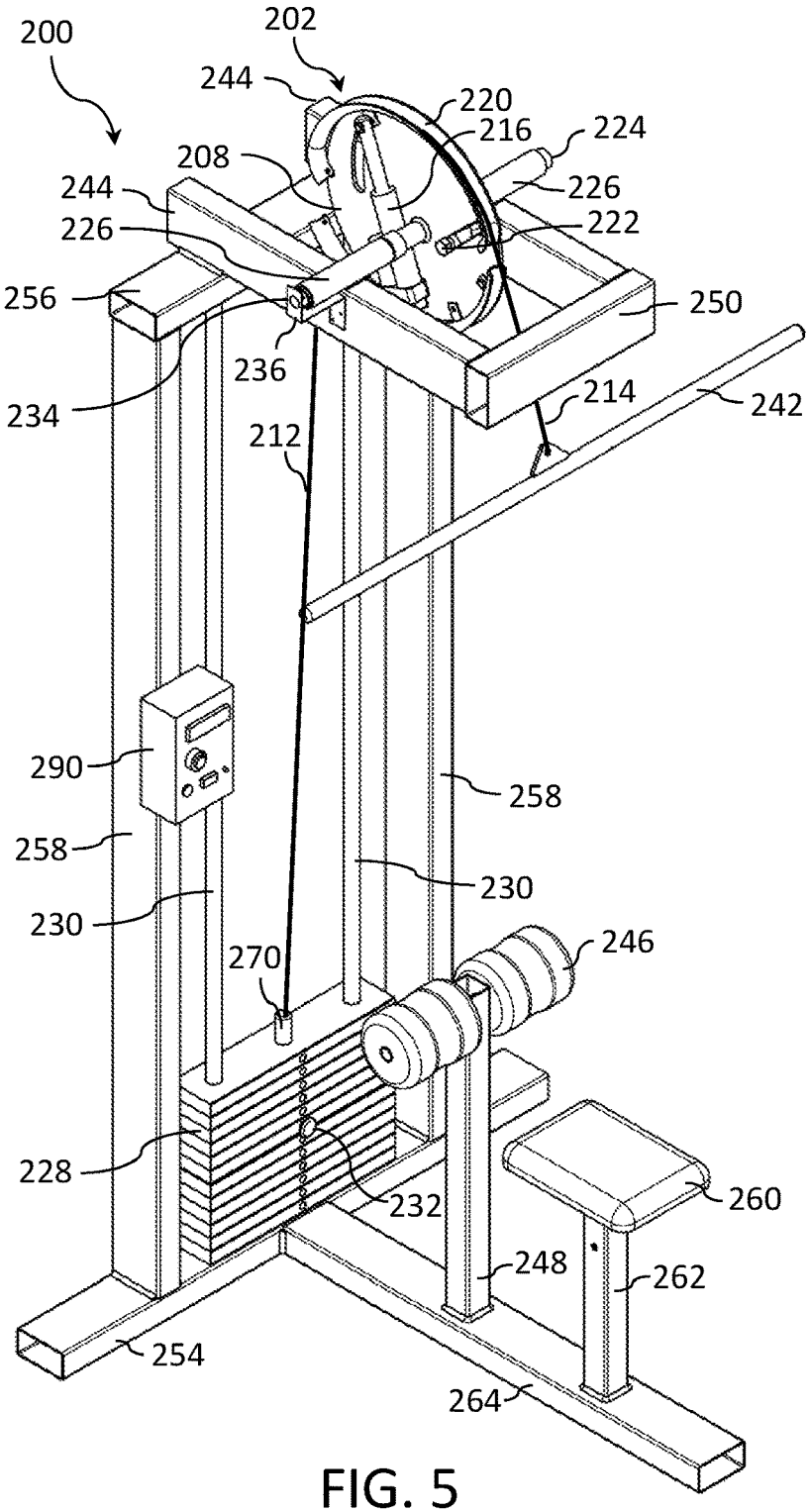
FIG. 5 is a front oblique view of a pulldown/pushdown apparatus in the rest condition with a variable resistance cam in a maximum radius condition.
Figure 6:
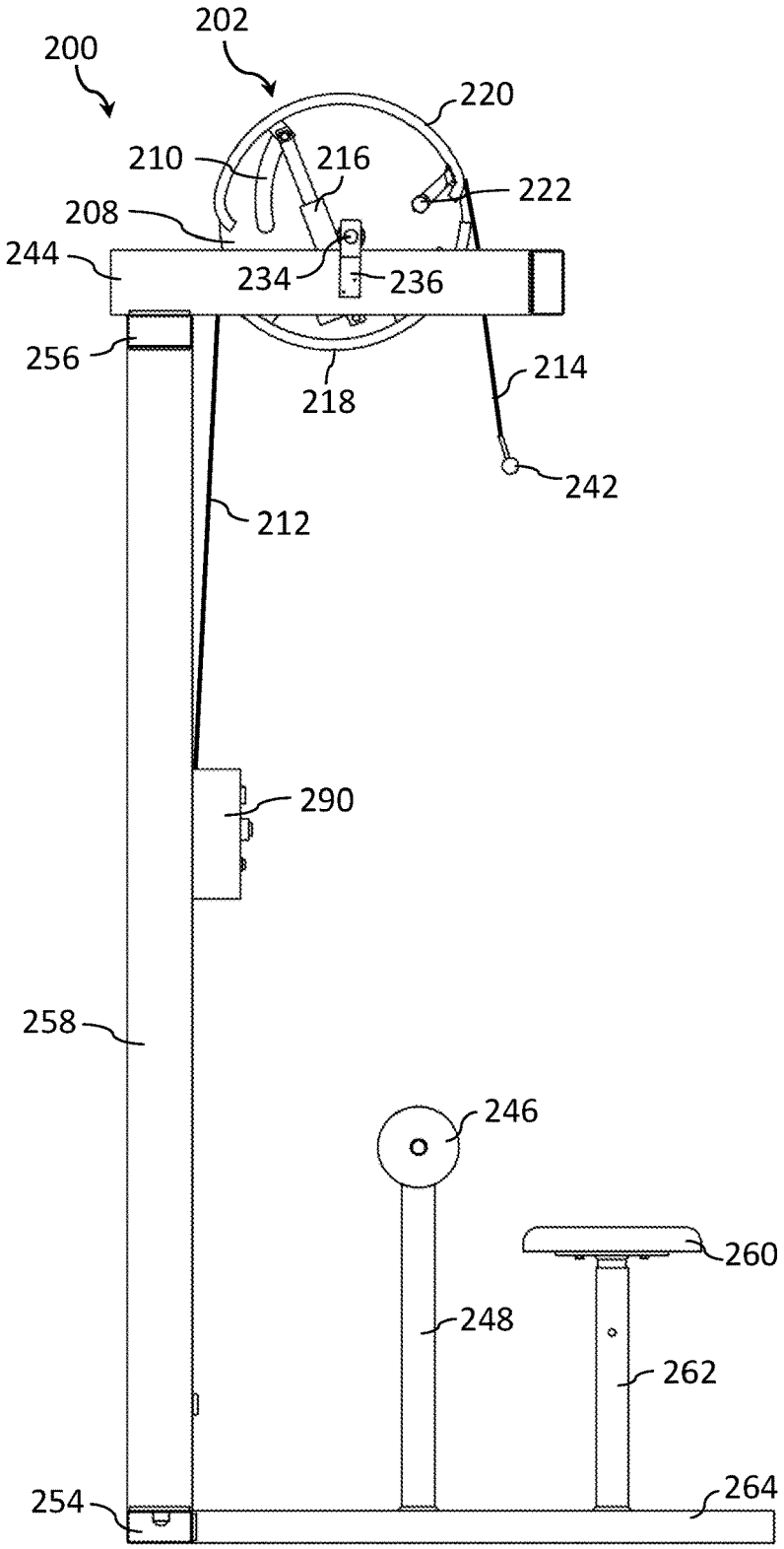
FIG. 6 is a side view of the pulldown/pushdown apparatus in the rest condition with a variable resistance cam in the maximum radius condition.
Figure 7:
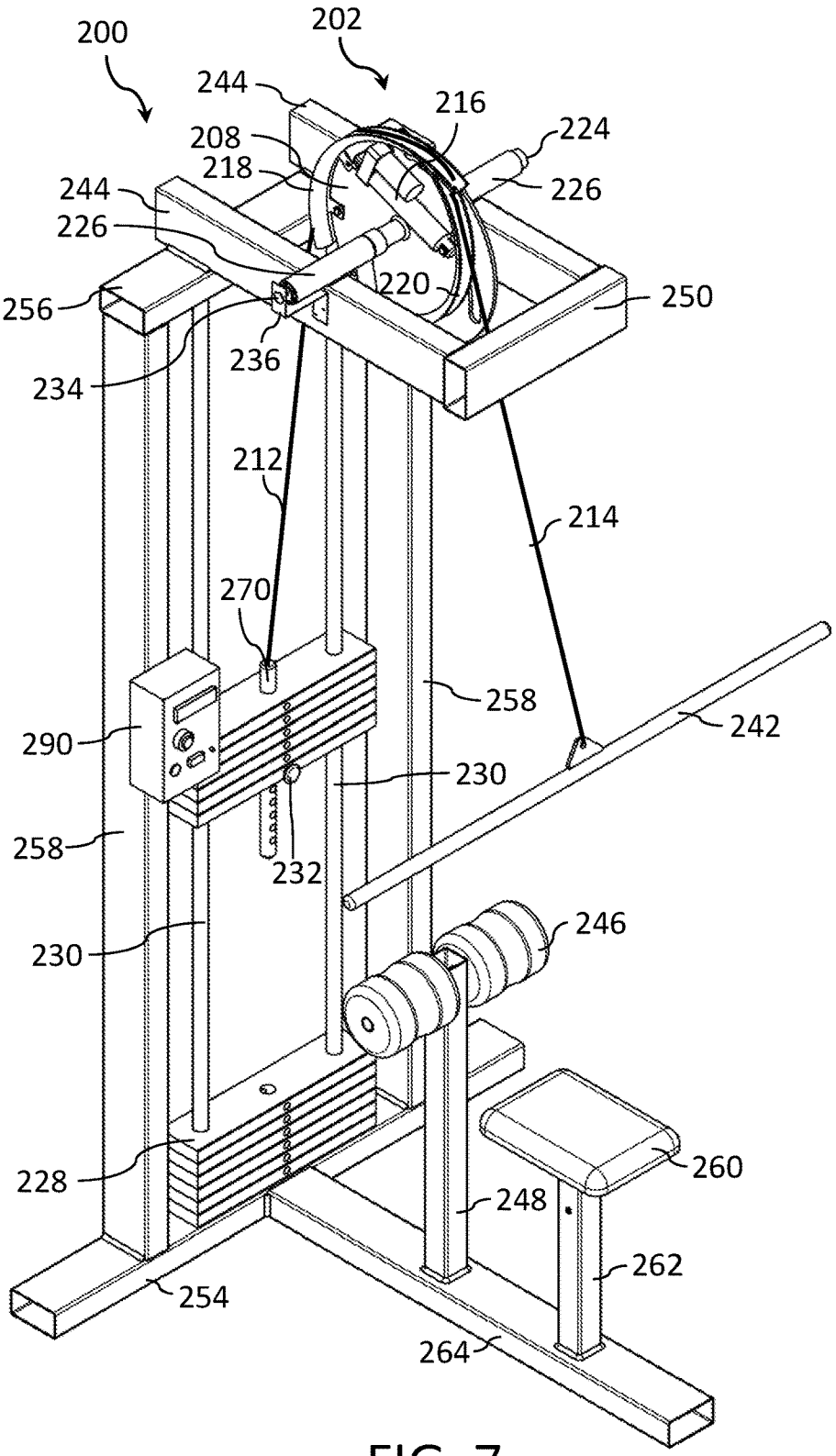
FIG. 7 is a front oblique view of the pulldown/pushdown apparatus in a lift condition with a variable resistance cam in a reduced radius condition

FIGS. 5-7 depict another configuration that represents a pulldown/pushdown weight machine 200 with a variable resistance cam 202 coupled to a weight plate stack 228 through a belt or cable 212. FIG. 5 depicts an oblique view of the weight machine 200 in a rest condition and a maximum cam radius. FIG. 6 depicts a side view of the weight machine 200 in a rest condition and a maximum cam radius. FIG. 7 depicts an oblique view of the weight machine 200 during a lift condition and with a reduced cam radius.

The pulldown/pushdown weight machine 200 may include various members that form a frame or structure for attachment of the various elements. The pulldown/pushdown weight machine 200 may include a base support member 254. The base support member 254 may be coupled to a seat support base 264. In the configuration shown, the base support member 254 and the seat support base 264 form a T-shaped base. The base support member 254 and the seat support base 264 may include adjustable feet at various locations to facilitate leveling of the pulldown/pushdown weight machine 200. Additional base support members may be present and many other configurations are possible for defining the structure.

The pulldown/pushdown weight machine 200 may include one or more upright supports 258 that are coupled to the base support member 254. In the configuration shown, a pair of upright supports 258 that are spaced a distance apart are utilized. An upright cross support member 256 may be coupled to the upright supports 258 at an end opposite the base support member 254. For example, the base support member 254, the upright supports 258, and the upright cross support member 256 may form a rectangular frame. The frame may be configured to support a weight plate stack 228. The various elements may be fastened by bolts or welds.

The weight plate stack 228 may be guided by weight plate support bars 230. The weight plate stack 228 may include a weight selection mechanism 270 for adjusting the number of weighting elements that are attached (e.g., as described previously herein in relation to weight selection mechanism 170). A subset of the weight plates 228 may be selected by engaging a weight plate selector pin 232 to a selected weight within the weight plate stack 228. The weight plate support bars 230 may be attached at one end to the upright cross support member 256 and at an opposite end to the base support member 254. The upright supports 258 may rigidly attach to the upright cross support member 256 and the base support member 254. Note that the weight stack 228 may be configured similar to that described previously herein in relation to FIGS. 1-4.

The pulldown/pushdown weight machine 200 may include a seat support upright 262 that is coupled to the seat support base 264. Attached to the seat support upright 262 may be a seat 260. The seat 260 may be cushioned. A leg support upright 248 may be coupled to the seat support base 264. A leg support pad 246 may be coupled to the leg support upright 248 at an end opposite the seat support base 264. The leg support pad 246 may include portions on opposite sides of the leg support upright 248. The leg support pad 246 may include a solid base surrounding by a padded material. During a lift, the user can place their knees under the leg support pad 246 that is supported by leg support upright 248. Also, during the lift, the user may sit on the seat 260 that is supported by the seat support upright 262.

The pulldown/pushdown weight machine 200 may further include a structure for securing the variable resistance cam 202. One or more cam support members 244 may be coupled to the upright cross support member 256. A cam support cross member 250 may be coupled between the cam support member 244 to form a rectangular frame for supporting the variable resistance cam 202. The frame may be configured to support the weight of the weight stack 228 during a lift.

The variable resistance cam 202 includes a cam disk 208 coupled to a pivot axis tube 224 that intersects the cam disk 208 at a generally perpendicular angle. The point of intersection may be the center of the cam disk 208. The point of intersection may also be offset from the center to provide a tailored resistance profile. The pivot axis tube 224 defines the rotational axis of the variable resistance cam 202. The pivot axis tube 224 may be supported by one or more pivot supports 226. The pivot supports 226 may be of tubular construction and sized to receive the pivot axis tube 224 within the tube. The pivot supports 226 may include a tube on each side of the variable resistance cam 202. The pivot axis tube 224 may rotate concentrically with respect to the pivot supports 226. The pivot supports 226 can be attached to the cam support members 244 which are rigidly attached to the upright cross support member 256. The pivot supports 226 may include one or more bearings to facilitate motion of the pivot axis tube 224 relative to the pivot supports 226. The interface between the pivot axis tube 224 and the pivot supports 226 may include lubrication to reduce friction.

A lift cable guide 220 may be attached to the cam disk 208 at a predetermined location of the cam disk 208 to further define a tailored resistance profile. The lift cable guide 220 may be coupled to a one end of a lift cable 214. A bar 242 (or other force application member) may be coupled at an opposite end of the lift cable 214. The lift cable guide 220 may be configured to rotate with the cam disk 208. The lift cable guide 220 may be configured with a variety of different profiles and attachment points to vary the effective load resistance curve the user experiences throughout a lift. The lift cable guide 220 may be attached to the cam disk 208 with a cable guide pivot 222 which may be a rotational hinge joint. This allows the lift cable guide 220 to pivot about the cable guide pivot 222 to change the position of the lift cable guide 220 relative to the cam disk 208. Along a surface in which a lift cable 214 is expected to be in contact with the lift cable guide 220, the lift cable guide 220 may be configured with edges to aid in maintaining the lift cable 214 along a path defined by the lift cable guide 220. For example, the lift cable guide 220 may have a rounded cross-section to provide a path along which the lift cable 214 may be routed. The lift cable guide 220 may have a circular profile that routes a lift cable 214 along a circular path about the cam disk 208. The cable guide 220 may be implemented in a variety of profiles to vary an effective load resistance. The predetermined location at which the cable guide 220 is attached may also affect the effective load resistance. In this configuration, the lift cable guide 220 is attached to the lift cable 214, as opposed to the weight cable in the previous configuration. In this configuration, extending the linear actuator 216 reduces the resistance experienced by the user.

A weight cable guide 218 may be attached to the cam disk 208 at a predefined location. A weight cable 212 may be connected at one end to the weight plate stack 228. The weight cable 212 may be connected at an opposite end to the weight cable guide 218. The weight cable guide 218 may be coupled about a periphery of the cam disk 208 that is generally opposite the lift cable guide 220. The weight cable guide 218 may be rigidly fixed to the cam disk 208. The weight cable guide 218 may include features similar to those of the lift cable guide 220. The weight cable guide 218 may be configured to route the weight cable 212 along a path defined by the weight cable guide 218.

The lift cable 214 may move radially into the lift cable guide 220 as the bar 242 is pulled. As the bar 242 is pulled or pushed down, the lift cable 214 applies force to the lift cable guide 220, which rotates the cam disk 208. As the cam disk 208 rotates, the weight cable guide 218 tensions the weight cable 212 thereby causing the weight plates 228 to move.

The lift cable guide 220 may be radially displaced by one or more actuators 216 or other actuation mechanism that may be attached to the cam disk 208. In some configurations, the one or more actuators 216 may attached to the lift cable guide 220. For example, the one or more actuators 216 may be a linear actuator as described previously herein. In some configurations, two linear actuators 216 may be used in parallel to satisfy force requirements for moving the lift cable guide 220. The cam disk 208 may define a cam window 210. The cam window 210 may allow two linear actuators 216 to be mechanically connected through the cam disk 208, one on each side. The actuators 216 may be electrically coupled to an electronic control unit 290 using electrical cables. The electronic control unit 290 executes the logic to determine whether to increase or decrease resistance. As the actuators 216 are extended or retracted, the lift cable guide 220 moves with respect to the periphery of the cam disk 208. This movement varies the radial tangent distance between the lift cable 214 and the pivot axis tube 224 which varies the effective resistance that the user experiences through the bar 242. Also, rigidly attached to the cam disk 208, opposite to the lift cable guide 220, is the weight cable guide 218. In some configurations, the one or more actuators 216 may be in contact with and not necessarily attached to the lift cable guide 220. For example, a roller mechanism may be attached to an end of the actuator 216 that is in contact with the lift cable guide 220. Such configurations may rely on the weight applied to the lift cable guide 220 to move the lift cable guide 220 toward the axis.

An angular motion sensor 234 (for example, a rotary potentiometer) may be coupled to the pivot axis tube 224 and held in place by a rotary sensor bracket 236. The angular motion sensor 234 may be as previously described herein (e.g., angular motion sensor 134). The angular motion sensor 234 may be aligned axially with the pivot axis tube 224 and may be configured to measure the instantaneous angle of the pivot axis tube 224 and transmit the signal to the electronic control unit 290. The angular motion sensor 234 may be secured to the pivot supports 226 or the cam support members 244 using an angular motion sensor bracket 236. The angular motion sensor bracket 236 may be configured to couple non-rotating portions of the angular motion sensor 234 securely to the pivot supports 226 or the cam support members 244.

The output of the angular motion sensor 234 provides a signal indicative of the angular position of the cam disk 208. The angular position may be an angle relative to the resting position and may be referred to as a lift angle. Further, a speed of rotation may also be derived from the position signal. By differentiating the position signal an angular velocity of the cam disk 208 may be computed. In addition, a derivative of the angular velocity provides an angular acceleration of the cam disk 208. The position, velocity, and acceleration values may be used to control operation of the linear actuator 216. The control device receiving the output signal of the angular motion sensor 234 may be programmed to compute the angular position, angular velocity, and angular acceleration values. A starting position of a repetition may be a position that is greater than the resting position of the cam disk 208. Learning a starting position may begin when the angular position changes from the resting position of the cam disk 208. For some configurations, the starting position of the repetition may be the same as the resting position of the cam disk 208. An alternative method of estimating the angular velocity of the cam disk 108, without the noise inherent in numerical differentiation, is to monitor the angular displacement over a fixed time interval to determine if the angular velocity exceeds a predetermined threshold.

The pushdown/pulldown weight machine 200 provides a resistance to motion that depends on various factors. The weight of the weight plates 228 coupled to the lift cable guide 220 affects the resistance. Further, the lift cable guide 220 can be rotated to change the effective radius of the variable resistance cam 202. The resistance further depends on the radial tangent distance between the axis defined by the pivot axis tube 224 and point at which the lift cable 214 contacts the lift cable guide 220. For example, the resistance torque is the product of the radial distance defined by the position of the lift cable guide 220 and the weight of the weight stack 228. The radial tangent distance may be from the axis defined by the pivot axis tube 224. In addition, the resistance may further depend on the radial tangent distance between the axis defined by the pivot axis tube 224 and the point at which the weight cable 212 contacts the weight cable guide 218.

The user grips the bar 242 to begin a lift. The force from the user is transferred from the bar 242 through the lift cable 214 to the variable resistance cam 202. The resistance provided by the variable resistance cam 202 may depend on the weight selected by the weight stack 228 and the radial displacement of the lift cable guide 220.

The lift cable guide 220 may be displaced or moved by the actuator 216 which changes the effective radius of the cam disk 208. The effective resistance may be a function of the radial tangent distance from the pivot axis defined by the pivot axis tube 224 and the point at which the lift cable 214 intersects the lift cable guide 220. By operating the actuator 216, the radial tangent distance may be varied which causes a change in the torque resistance sensed by the user at the lift bar 242.

In some configurations, the weight cable guide 218 may be displaced in a manner similar to the lift cable guide 220. In some configurations, only the weight cable guide 218 or the lift cable guide 220 may be displaced. In some configurations, both the weight cable guide 218 and the lift cable guide 220 may be displaced. Note that such configurations may increase the number of actuators that are needed. However, such a system may provide more resistance profiles that may benefit the user.

It should be noted that a multiplicity of weight training machines are possible with the variable resistance cam 202, including a leg extension machine, a leg curl machine, a pullover machine, a triceps extension machine, a rowing machine, to name a few examples. By arranging the variable resistance cam 202 in various configurations, various exercise machines may be formed.

Figure 8:
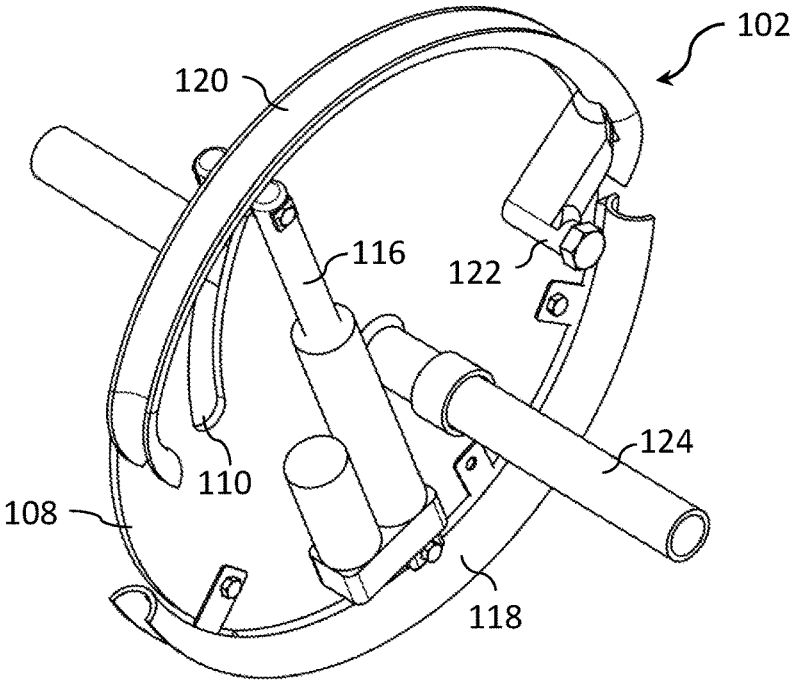
FIG. 8 is an oblique view of a possible configuration of the variable resistance cam in a maximum radius condition.
Figure 9:
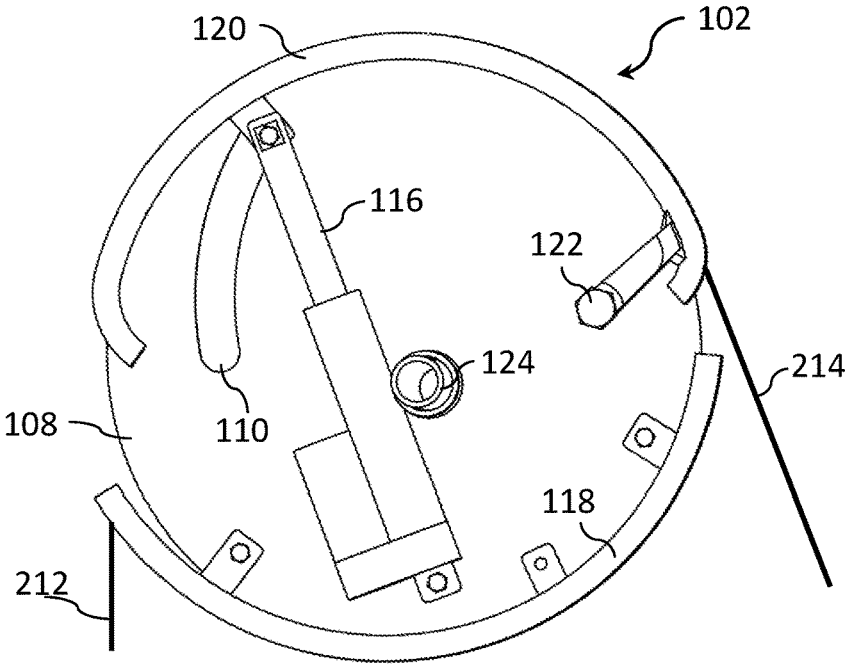
FIG. 9 is a side view of a possible configuration of the variable resistance cam in a maximum radius condition.
Figure 10:
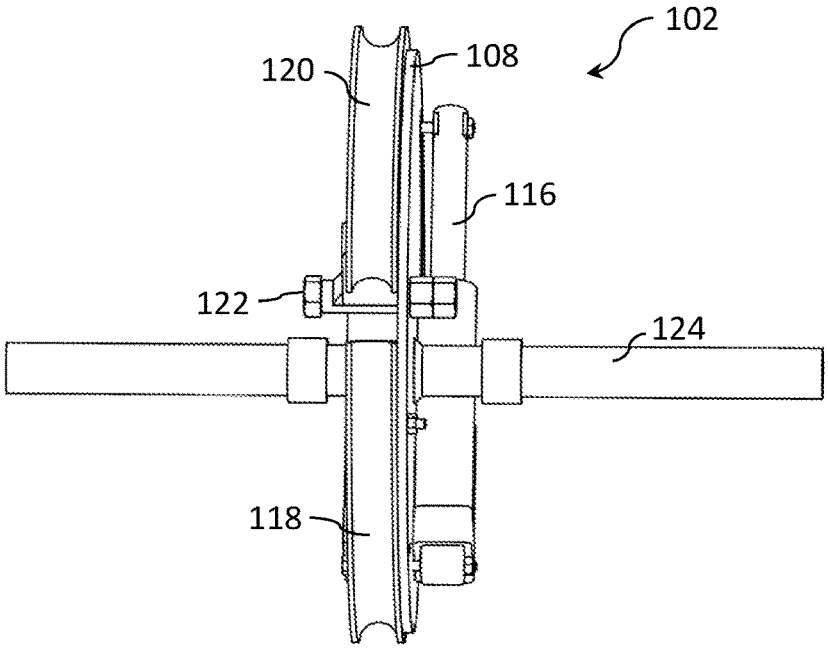
FIG. 10 is a front view of a possible configuration of the variable resistance cam in a maximum radius condition.
Figure 11:
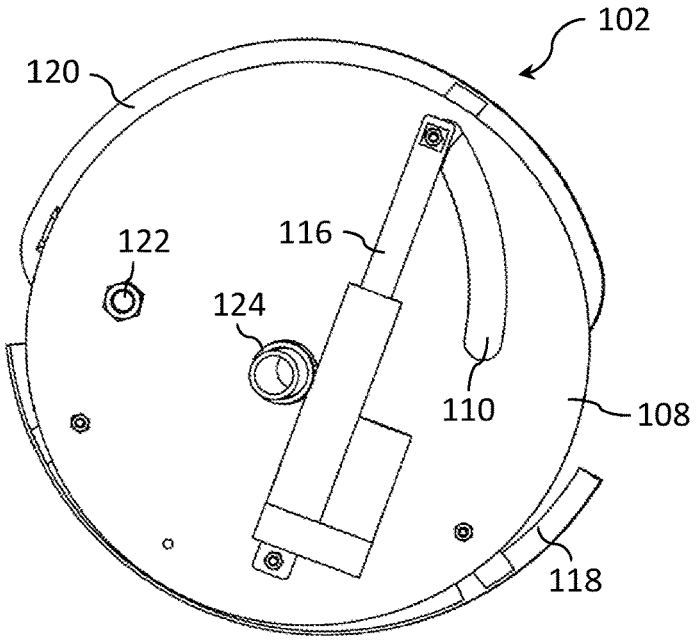
FIG. 11 is a possible side view, opposite the side of FIG. 9, of a possible configuration of the variable resistance cam in a maximum radius condition.
Figure 12:
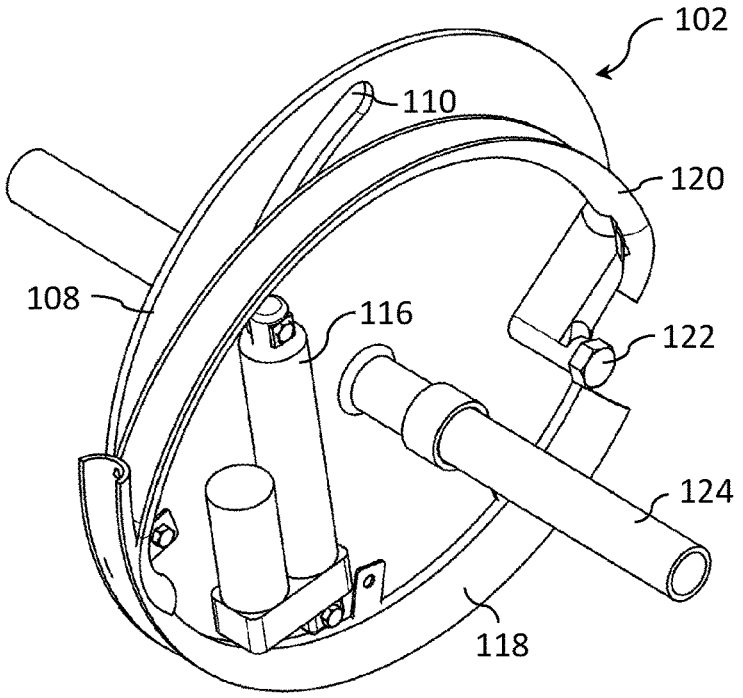
FIG. 12 is an oblique view of a possible configuration of the variable resistance cam in a reduced radius position.
Figure 13:
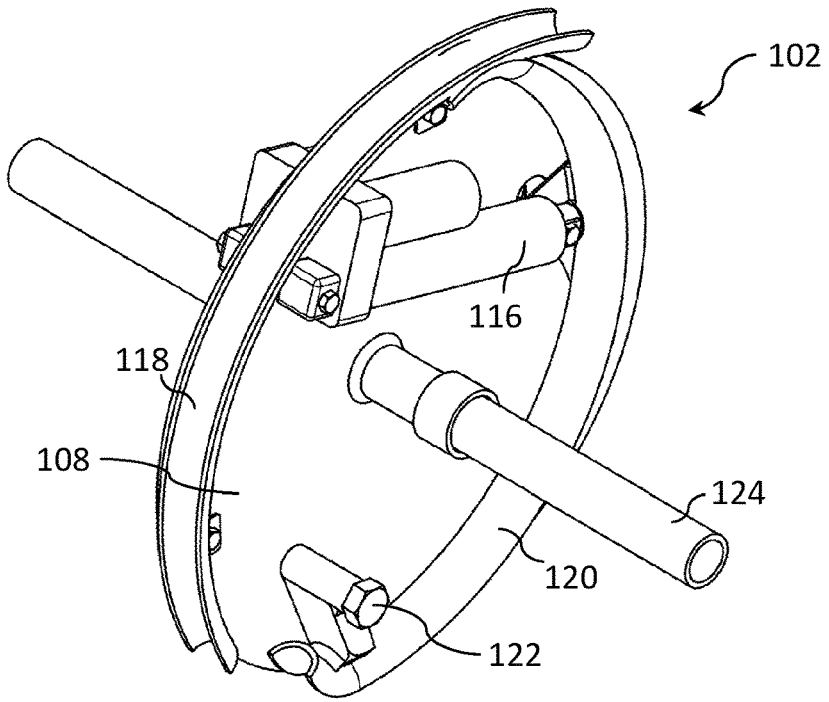
FIG. 13 is an oblique view of a possible configuration the variable resistance cam in a reduced radius position and rotated about an axis.

FIGS. 8-13 depicts various views of the variable resistance cam 102 with cable guide 120 driven by one or more actuators 116. The variable resistance cam 102 is also depicted with a weight cable guide 118 that may function as described in relation to variable resistance cam 202 (element 218). Note that the views and description are applicable to the variable resistance cam 202 from FIGS. 5-7 as well. FIGS. 8 and 9 depict an oblique view and a side view, respectively, of the variable resistance cam 102 that is in the initial position with the rotating cable guide 120 in a fully extended with maximum radius and maximum load condition. FIG. 10 shows a front view of the variable resistance cam 102. FIG. 11 shows an opposite side view of that depicted in FIG. 9 depicting a second linear actuator 116. FIG. 12 depicts an oblique view of the variable resistance cam 102 with the cable guide 120 retracted to a reduced radius or reduced load condition. FIG. 13 depicts an oblique view of the variable resistance cam 102 rotated up to the top of the lift curve and the cable guide 120 retracted a reduced radius or reduced load condition.

An alternative configuration of the variable resistance cam 102 is possible in which the cable guide 120 is flipped with respect to the previous configuration. In this case the positions of the cable guide pivot 122 and the variable resistance cam 102 and the linear actuator 116 may be swapped.

Figure 14:
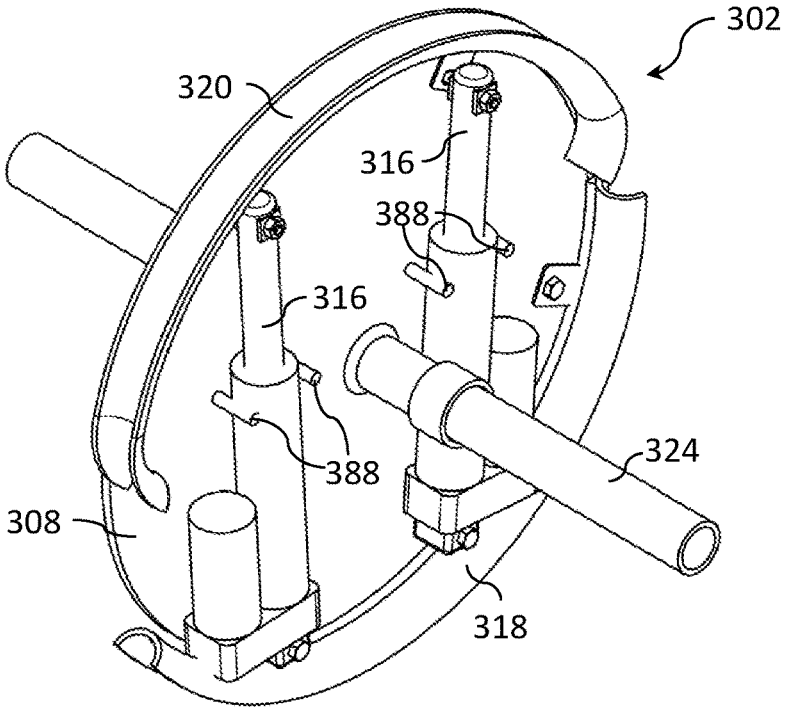
FIG. 14 is an oblique view of a possible configuration of a variable resistance cam with two actuators on the same side and in a maximum radius condition.
Figure 15:
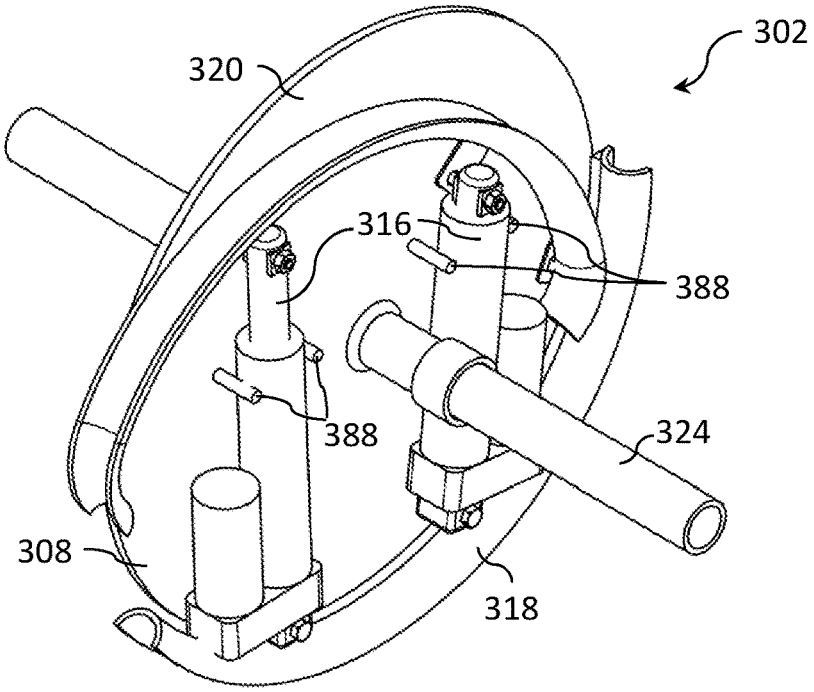
FIG. 15 is an oblique view of a possible configuration of a variable resistance cam with two actuators on the same side and in a reduced radius condition.

FIG. 14 depicts another configuration of the variable resistance cam 302 in which two linear actuators 316 are used to control the position of the movable cable guide 320. The variable resistance cam 302 may include a weight cable guide 318. The linear actuators 316 can be controlled independently to provide a plurality of load profile curves to the user during the lift. The linear actuators 316 may be supported laterally by actuator support posts 388 that are attached rigidly to the cam disk 308. FIG. 14 depicts this configuration in a maximum radius or full load position. FIG. 15 depicts this configuration in a reduced radius or reduced load position. The movable cable guide 320 may include brackets that receive a pin. The actuators 316 may be coupled to the movable cable guide 320 with the pin that allows some rotation of the bracket at the pin to allow the movable cable guide 320 to adjust when one of the actuators 316 is moved. By moving the actuators 316, the movable cable guide 320 may be positioned to change the radial distance from an axis defined by the pivot axis tube 224. The radial distance affects the amount of torque transferred through the variable resistance cam 302. In some configurations, the movable cable guide 320 may be constructed of a flexible elastic material to allow a change in profile between the attachments of the linear actuators 316. In some configurations, the cable guide 320 may comprise a plurality of independent or separate (e.g., not connected to one another) sections that may each be attached to one of a plurality of linear actuators.

Figure 16:
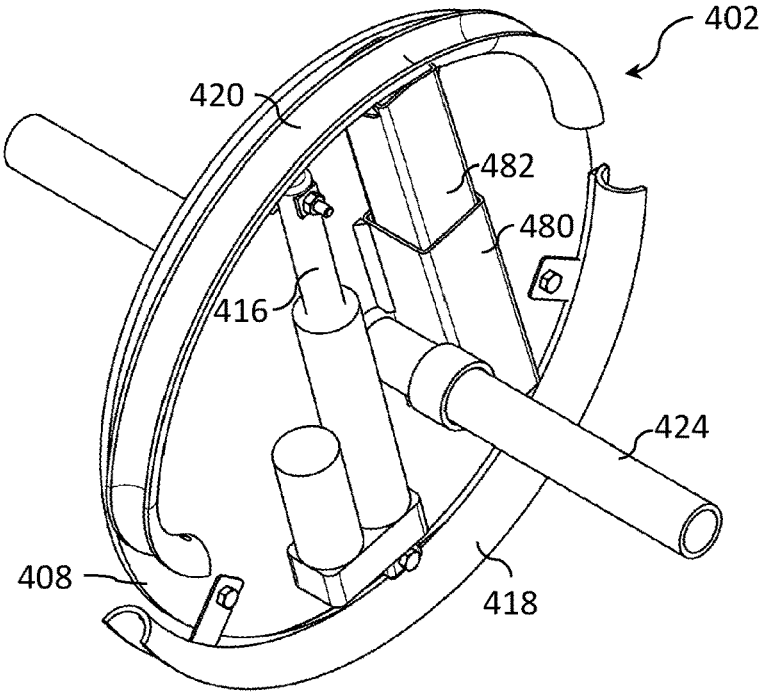
FIG. 16 is an oblique view of a possible configuration of a linear displacement variable resistance cam in a maximum radius condition.
Figure 17:
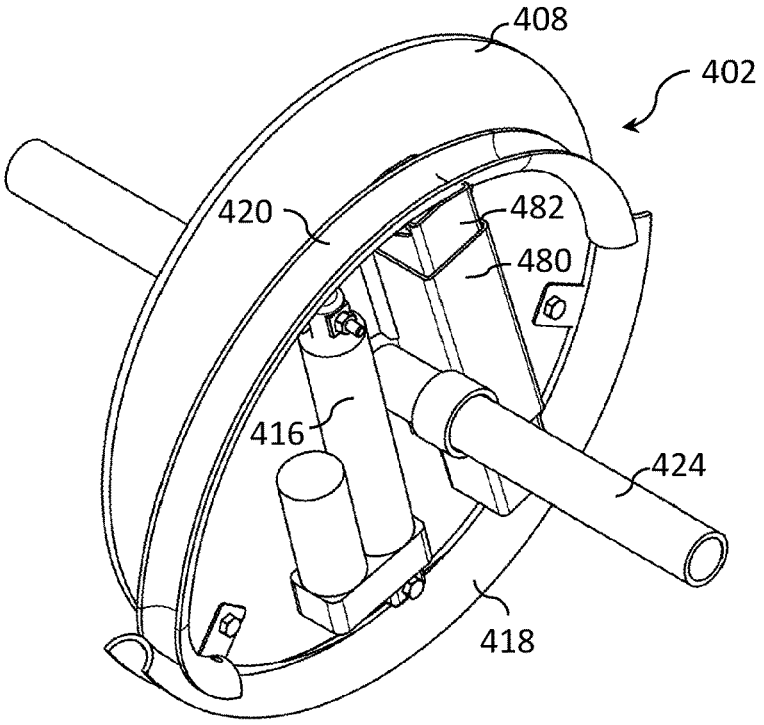
FIG. 17 is an oblique view of a possible configuration of a linear displacement variable resistance cam in a reduced radius condition.

FIG. 16 depicts another configuration of the variable resistance cam 402 in which the rotating cable guide pivot is replaced by a sliding cable guide 420. The variable resistance cam 402 may include a weight cable guide 418. A linear actuator 416 may be used to translate the sliding cable guide 420. The sliding cable guide 420 is guided in translation by a slide arm 482 that translates axially in a slide support sleeve 480. The slide support sleeve 480 is rigidly attached to the cam disk 408. The slide arm 482 may be rigidly attached to the sliding cable guide 420. This changes the adjustment method from rotation to translation and still allows for a plurality of load profile curves, depending on the attachments and geometry of the sliding cable guide 420. The sliding cable guide 420 may only allow for translation in the axial direction, with no rotation. Operating the actuator 416 may cause the sliding cable guide 420 to change the radial distance from the axis defined by the pivot axis tube 424. FIG. 16 shows this configuration in the maximum radius or full load position. FIG. 17 shows this configuration in a reduced radius or reduced load position.

Figure 18:
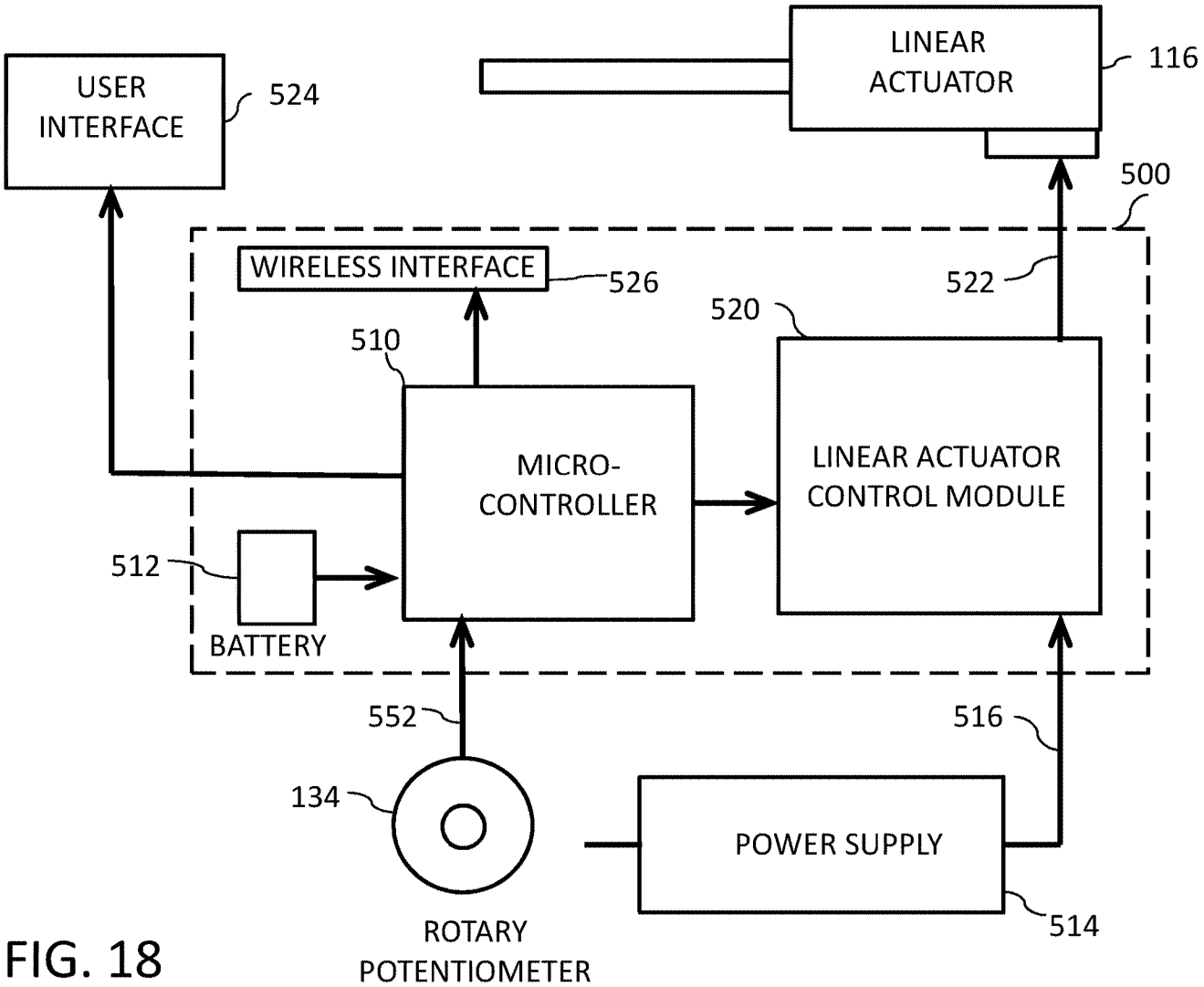
FIG. 18 is a diagram of an electronic control system.

FIG. 18 depicts an electronic control unit 500 (also depicted as electronic control unit 190 and 290) and a user interface module 524 that may be used to control and monitor the exercise apparatus. The ECU 500 may include a microcontroller 510. The microcontroller 510 may be powered by a low voltage battery 512. In some configurations, the low voltage battery 512 may be a backup power source to permit operation and retention of data during power outages.

The ECU 500 may include a linear actuator control module 520 that is configured to operate the linear actuator 116. The linear actuator control module 520 may include switching devices for selectively switching power and return signals to linear actuator motor wires 522. For example, the switching devices may include relays and/or solid-state devices (e.g., bi-polar transistors, field-effect transistors, and/or complementary metal oxide semiconductors) to control voltage and current supplied to the linear actuator 116. In some configurations, integrated circuits may be utilized that include solid-state switching devices. The configuration of the linear actuator control module 520 may depend on the type of electric motor in the linear actuator 116 (e.g., DC, AC induction, etc.). The linear actuator control module 520 may receive power from a power supply 514. The power supply 514 may supply power via a power supply cable 516. For example, the power supply 514 may be an AC to DC converter that converts AC voltage from a power outlet to a predetermined DC voltage (e.g., 12 Volts). The power supply 514 may supply power to all components of the ECU 500.

The ECU 500 may include a wireless interface module 526 that is configured to provide wireless communication to external devices. The wireless interface module 526 may support wireless communication standards such as BLUETOOTH and/or wireless networking (Wi-Fi) as defined by Institute of Electrical and Electronics Engineers (IEEE) 802 family of standards (e.g., IEEE 802.11). The wireless interface module 526 may be configured to transfer data between the ECU 500 and a remote device such as phone, tablet and/or computer. The microcontroller 510 may be programmed to implement a communications protocol that is compatible with the supported wireless communication standards.

The ECU 500 may include one or more current sensors to measure current supplied to the linear actuators 116. A resistive network or a hall-effect current sensor may be used. The current sensor may provide a signal indicative of the magnitude and polarity of the current drawn by the linear actuator 116. The signal may be input to the microcontroller 510 for control and monitoring of the linear actuator 116. For example, the signal may be monitored to detect an end of travel of the linear actuator 116. When motion of the linear actuator arm is constrained or inhibited (e.g., motion inhibited due to end of travel) the current may increase as the electric motor stops rotating. The current may be monitored to detect the end of travel range condition. When an end of travel range condition is detected, the microcontroller 510 may reduce the current command to the linear actuator 116. For example, a voltage across terminals of the linear actuator 116 may be commanded to zero. In some configurations, the linear actuator 116 may include limit switches that are configured to trigger at the maximum stroke of the linear actuator 116. The limit switches may be configured to reduce the current when the travel limits are reached to protect the electric motor of the linear actuator 116. For example, the limit switch may interrupt the flow of current to the electric motor when triggered by contact.

Additionally, the magnitude of the current required to move the linear actuator 116 may be indicative of the amount of weight applied to the cable guide (e.g., 120). As the weight increases, the amount of current needed to move the linear actuator 116 may increase. A table of current values and weight values may be stored in non-volatile memory to determine the weight according the measured current. The table may be predefined based on calibration values.

The ECU 500 may include a voltage sensor to measure the voltage applied to the linear actuator 116. For example, a resistive network may be used. The voltage sensor may provide a signal indicative of the magnitude and polarity of the voltage applied to the linear actuator 116. The signal may be input to the microcontroller 510 for control and monitoring of the linear actuator 116.

The ECU 500 may include a connection interface that allows electrical connection of the various components. In some configurations, the electrical connections may be hard-wired via connectors. For example, the angular rotation sensor wires may be routed to the connection interface for input into the microcontroller 510. In some configurations, angular rotation sensor wires may be routed directly to the microcontroller 510. All sensors described herein may be electrically coupled via the connection interface. The connection interface may also include interface circuitry to scale and/or isolate input and output signals.

The microcontroller 510 may provide output signals to control the switching devices of the linear actuator control module 520. The microcontroller 510 may include one or more analog-to-digital (A/D) channels to convert the various input signals from analog to digital form. For example, A/D channels may be used for signals from the angular rotation sensor 134, the voltage sensor, and the current sensor. The angular rotation sensor 134 may be electrically coupled to the microcontroller 510 through an angular rotation sensor wiring cable 552. The microcontroller 510 may include a processor for executing instructions and volatile and non-volatile memory for storing data and programs. The microcontroller 510 may include various timer/counter inputs for processing data from other sensors.

The user interface 524 may be a dedicated user interface that is coupled to the exercise apparatus. The user interface 524 may include a display for outputting information to the user. The user interface 524 may include an input module. The input module may be configured to allow user input for configuring the exercise machine. For example, physical buttons may be included that allow the user to select various features. In some configurations, the user interface 524 may be a touch screen that allows display and input of information. The user interface 524 may be controlled and monitored by the microcontroller 510. In some configurations, the user interface 524 may include a dedicated microprocessor and communication with the microcontroller via serial data link. The user interface 524 may be configured to allow the user to selectively actuate the linear actuator 116 manually via menus or button presses. For example, pressing a retract button may cause the linear actuator 116 to retract while the retract button is pressed.

In other configurations, the user interface 524 may be a remote device. Communication between the microcontroller 510 and the user interface 524 may be via the wireless interface module 526. For example, an application may be executed on a tablet or smart phone that allows display of information to the user and allows the user to configure the exercise machine.

The ECU 500 may be utilized to monitor and control an exercise session. The ECU 500 may be programmed to extend and retract the linear actuator 116 by commanding the linear actuator 116. During an exercise session, the user may struggle to raise the weight stack 128 due to muscle fatigue or weakness. The microcontroller 510 may be programmed to detect a stall condition in which the user can no longer lift the weight. A stall condition may be identified as a condition in which the lift angle is increasing at a rate that is lower than a predetermined rate while the lift angle is within a predetermined range. If a stall condition is detected, the microcontroller 510 may be programmed to reduce the weight by controlling the linear actuator 116. For example, the linear actuator 116 may be controlled to position the cable guide 120 to reduce the effective radius of the variable resistance cam 102. The linear actuator 116 may also be controlled to maintain the reduced load position of the cable guide 120 until the lift angle begins to increase again.

The microcontroller 510 may be programmed to actuate the linear actuator 116 to achieve a selected resistance profile. Various open-loop and closed-loop strategies are available to achieve a selected resistance. Open-loop examples include monitoring the current and actuation time during operation of the linear actuator 116.

The weight profile may be expressed as target weights associated with lift angles. The weight profile may be defined over a selectable number of exercise cycles. In addition, the weight profile may change for each exercise cycle. For example, to maintain a constant resistance during an exercise cycle, the target weight may be varied for each lift angle. The target weight may be translated to a target position of cable guide 120. The target position may be defined by an amount of extension of the one or more actuators 116. A table of cable guide 120 positions indexed by lift angle may be computed and stored.

The position of the cable guide 120 may be estimated or measured. During the exercise cycle, the linear actuator 116 may be operated to achieve the target position that may vary during an exercise cycle. For example, an amount of travel of the cable guide 120 may be previously characterized as a set of current/voltage magnitudes and associated actuation times. During operation, the microcontroller 510 may compute the amount of travel necessary and apply an associated current/voltage for a corresponding time. In other configurations, the position of the cable guide 120 may be measured and this feedback may be used to control the voltage/current applied to the linear actuator 116. For example, a proportional-integral (PI) control strategy may be implemented by the microcontroller 510.

Figure 19:
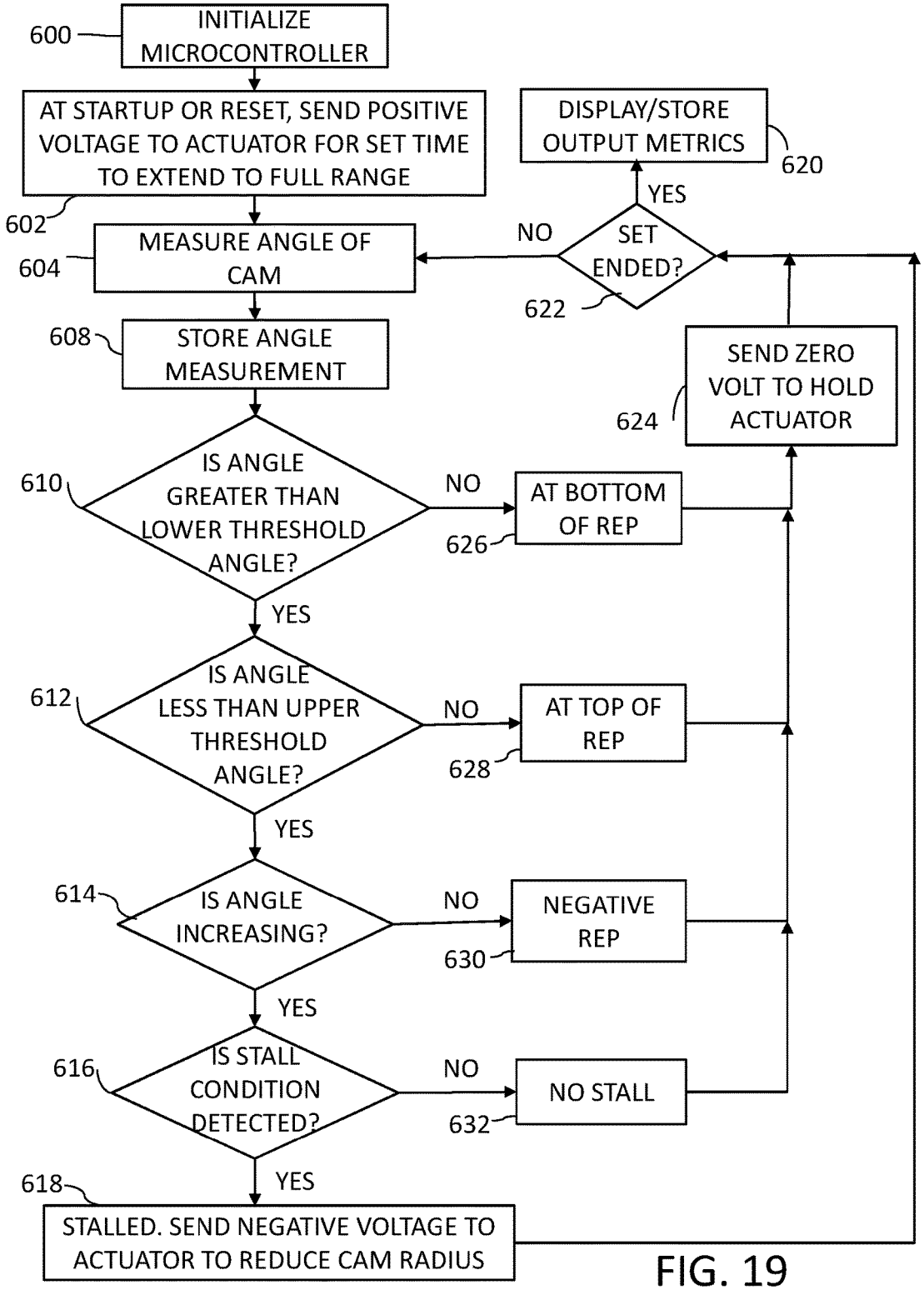
FIG. 19 is a possible logic flowchart depicting operations performed by the electronic control system for controlling operation of the mechanism.

FIG. 19 depicts a flowchart for a possible sequence of operations that may be implemented in the microcontroller 510 to detect and manage a stall condition. At operation 600, the microcontroller 510 may be initialized. Instructions may be executed to initialize variables for an exercise session. At operation 602, a positive voltage may be applied to the linear actuator 116 for a predetermined time (e.g., 5 seconds) to cause the cable guide 120 to be at a maximum radius from the pivot axis. In general, a voltage may be applied to place the cable guide 120 in a predetermined position. The particular voltage pattern may depend on the present position of the cable guide 120 and the target position of the cable guide 120.

At operation 604, the lift angle of the variable resistance cam 102 may be measured by sampling the signal from the angular rotation sensor 134. The measured lift angle may be an angle relative to the resting angle. The resting angle of the variable resistance cam 102 (e.g., angle measurement at which the weight stack 128 is resting may be known and stored in the microcontroller 510. At operation 608, the lift angle measurement may be stored in controller memory. For example, a buffer of lift angle measurements may be stored representing a predetermined number of angle measurements over a predetermined time interval. That is, angular position values are available from previous repetitions. A starting position and peak position may be determined by monitoring the angular positions during a repetition. For example, the peak position may be maximum angular position measured during the repetition and the starting position or bottom-most position may be the minimum angular position measured during the repetition. A total angular travel range may be defined by the peak position and the starting position. The peak position may be derived from the angular position signal measured during at least one previous repetition as the angular position value at which the angular position stops increasing. The starting position may be derived from the angular position signal measured during at least one previous repetition as the angular position value at which the angular position stops decreasing.

A stall condition may occur when the angular velocity of the variable resistance cam 102 approaches zero. To ensure proper detection of a stall situation, certain lift angles may be filtered out. For example, the angular velocity goes to zero at the top and bottom of an exercise cycle. At these points, the angular velocity is expected to change polarity and pass through zero. Realizing this, one can exclude these points by detecting a stall condition only within a predetermined range of lift angles.

At operation 610, the lift angle measurement may be compared to a lower threshold value (e.g., 20 degrees). The lower threshold value may correspond to an angle indicative of approaching a bottom-most position of an exercise cycle at which angular velocity is expected to approach zero (e.g., angular position stops decreasing). Operation 626 may be executed if the lift angle measurement is less than or equal to the lower threshold value. At operation 626, a flag may be set indicating the bottom of an exercise cycle. Operation 624 may then be executed to hold the linear actuator 116 in the current position. For example, no voltage is applied to the linear actuator 116. The lower threshold value may be a minimum angular position of the predetermined range of lift angles and may be a predetermined percentage greater than the starting angular position of the total angular travel range.

Operation 612 may be executed if the lift angle measurement is greater than the lower threshold value. At operation 612, the measured angle may be compared to an upper threshold value (e.g., 95 degrees). The upper threshold value may correspond to an angle indicative of approaching a top-most position of an exercise cycle at which angular velocity is expected to approach zero (e.g., angular position stops increasing). Operation 628 may be executed if the measured lift angle is greater than or equal to the upper threshold value. At operation 628, a flag may be set indicating the top of an exercise cycle. Operation 624 may then be executed to hold the linear actuator 116 in the current position.

Operation 614 may be executed if the lift angle measurement is less than the upper threshold value. At operation 614, a check is made to determine if the lift angle in increasing. A rate of change of the angular position (e.g., angular velocity) may be computed and compared to a predetermined threshold. For example, an angular velocity greater than zero may be indicative of an increasing lift angle. In another example, a maximum angle from the previous three measurements may be computed. A difference between the maximum angle and the current angle measurement may be computed and compared to a threshold (e.g., 7 degrees). If the angle is not increasing, then operation 630 may be executed. At operation 630, a flag may be set indicating a negative exercise cycle. That is, the variable resistance cam 102 is moving toward the rest position. Operation 624 may then be executed to hold the linear actuator 116 in the current position. The upper threshold value may be a maximum angular position of the predetermined range of lift angles and may be a predetermined percentage less than the peak angular position of the total angular travel range.

If the angle is increasing, then operation 616 may be performed. At operation 616 a stall condition is monitored. A rate of change of the measured lift angle may be computed. If the rate of change is less than a predetermined rate, a stall condition may be detected. The rate of change may be monitored to determine if the polarity of the rate of change reverses. This may be indicative of a stall condition. For example, a difference between the present angle measurement and the maximum angle from the previous three angle measurements may be computed and compared to a stall threshold (e.g., 16 degrees). If a stall condition is not detected, then operation 632 may be performed. At operation 632, a flag may be set indicate a non-stall condition. Operation 624 may then be executed to hold the linear actuator 116 in the current position.

If a stall condition is detected, then operation 618 may be performed. At operation 618 a flag may be set indicating the stall condition. The linear actuator 116 may be operated to change the radial tangent distance to decrease the amount of force transferred through the variable resistance cam 102. For example, the linear actuator 116 may be operated to reduce the radius of the variable resistance cam 102. The effect is to reduce the load so that the exercise cycle may continue. For example, the microcontroller 510 may apply a negative voltage to the terminals of the linear actuator 116. If the angular velocity begins to increase again, the voltage may be set to zero to hold the position.

After operation 624 and operation 618, operation 622 may be performed. At operation 622, a check is performed to determine if the exercise session has ended. For example, a number of exercise cycles may be monitored and if the number is greater than a target number, the set may be complete. Alternatively, the lift angle may indicate that the variable resistance cam 102 is in the rest position for more than predetermined inactivity time. In some configurations, a user input received from the user interface 524 may indicate the end of the exercise session. If the set has not ended, the sequence may repeat starting at operation 604. The sequence starting at operation 604 may be repeated at periodic time intervals according to a selected sample rate. For example, the sequence of operations may be repeated every 0.25 seconds. If the exercise session is complete, operation 620 may be performed. At operation 620, exercise metrics may be computed. The exercise metrics may be stored in non-volatile memory for later retrieval. The exercise metrics may also be displayed on the display or remote device.

The microcontroller 510 may be programmed to calculate an average force and energy lifted during the exercise session to provide a continuous performance metric. For example, the weight mounted to the weight stack 128 along with a resistance associated with the apparatus itself may be estimated. In some configurations, the current applied to move the cable guide 120 may be monitored during motion. The weight may be obtained from a lookup table indexed by the current measurement. In other configurations, the weight may be entered via the user interface 524.

The applied force may be estimated based on the weight, radial tangent distance between the axis of rotation and the cable guide, radial tangent distance between the axis of rotation and the weight cable guide, and the angular acceleration. The minimum torque required to begin moving the variable resistance cam 102 may be computed as discussed herein. The torque for accelerating the variable resistance cam 102 may be computed from the angular acceleration and a moment of inertia of the variable resistance cam 102. The weight and radial tangent distances may be used to compute the inertia of the variable resistance cam 102. The inertia may be computed by the microcontroller 510 based on measured and stored parameters associated with the apparatus. In addition, the inertia may change dynamically during an exercise cycle based on the lift angle and mode of control (e.g., change in radius of variable resistance cam 102). The force may be computed from the torque values. Alternatively, assuming the angular velocity is negligible, the force may be computed as a static summation of the moments about the rotational axis. An average force may be computed during the exercise session and stored in non-volatile memory and output to the user interface 524. Knowing the force and/or torque, an amount of energy expended may be computed, stored in non-volatile memory and output to the user interface 524.

Additional metrics may be computed. For example, the number of exercise cycles during the exercise session may be computed by counting the number of up/down cycles. In addition, an average force or energy per repetition may be computed for the exercise session. A total amount of weight lifted may be computed as a sum of the weights (or average weight) associated with each exercise cycle. An average rotational speed over the exercise cycle may be computed. Various other performance metrics may be computed and output to the user interface 524.

The ECU 500 may be programmed to estimate an average force over a number of repetitions. The number of repetitions may be a targeted number selected by the user depending upon specific fitness goals. The average force value may be stored in memory and displayed via the user interface 524. For example, computing an average force over six repetitions may be useful for monitoring strength increases. Computing an average force over ten repetitions may be useful for monitoring for muscle hypertrophy. Computing an average force over fourteen repetitions may be useful for monitoring endurance. In addition, an average energy for a set of repetitions may be computed. The metrics provide an improved indication of exercise progress.

The ECU 500 may also be utilized to implement various weight profiles during an exercise session. For example, the microcontroller 510 may be programmed to vary the weight according to a user selected profile. A profile that varies the resistance during an exercise cycle may be implemented. For example, a resistance profile may start with a lower resistance at the bottom of the exercise cycle and increase as the angle increases. A profile that maintains a constant resistance over the entire exercise cycle may be selected. For example, the microcontroller 510 may be programmed to vary the position of the cable guide 120 to maintain a constant resistance as a function of the lift angle. Numerous other profiles are possible.

To achieve a particular resistance, the target resistance value may be translated to a target position of the cable guide 120. The target position may be a function of the weight applied to the variable resistance cam 102 which may be measured or estimated. The microcontroller 510 is programmed to operate the linear actuator 116 to achieve the target position during the exercise session. The target position may vary during an exercise cycle such that the cable guide 120 moves (e.g., retracts and extends) relative to the pivot axis tube 124 during the exercise cycle. Other profiles may maintain a constant target position during an exercise cycle and change the target position at the start of the next exercise cycle.

Figure 20:
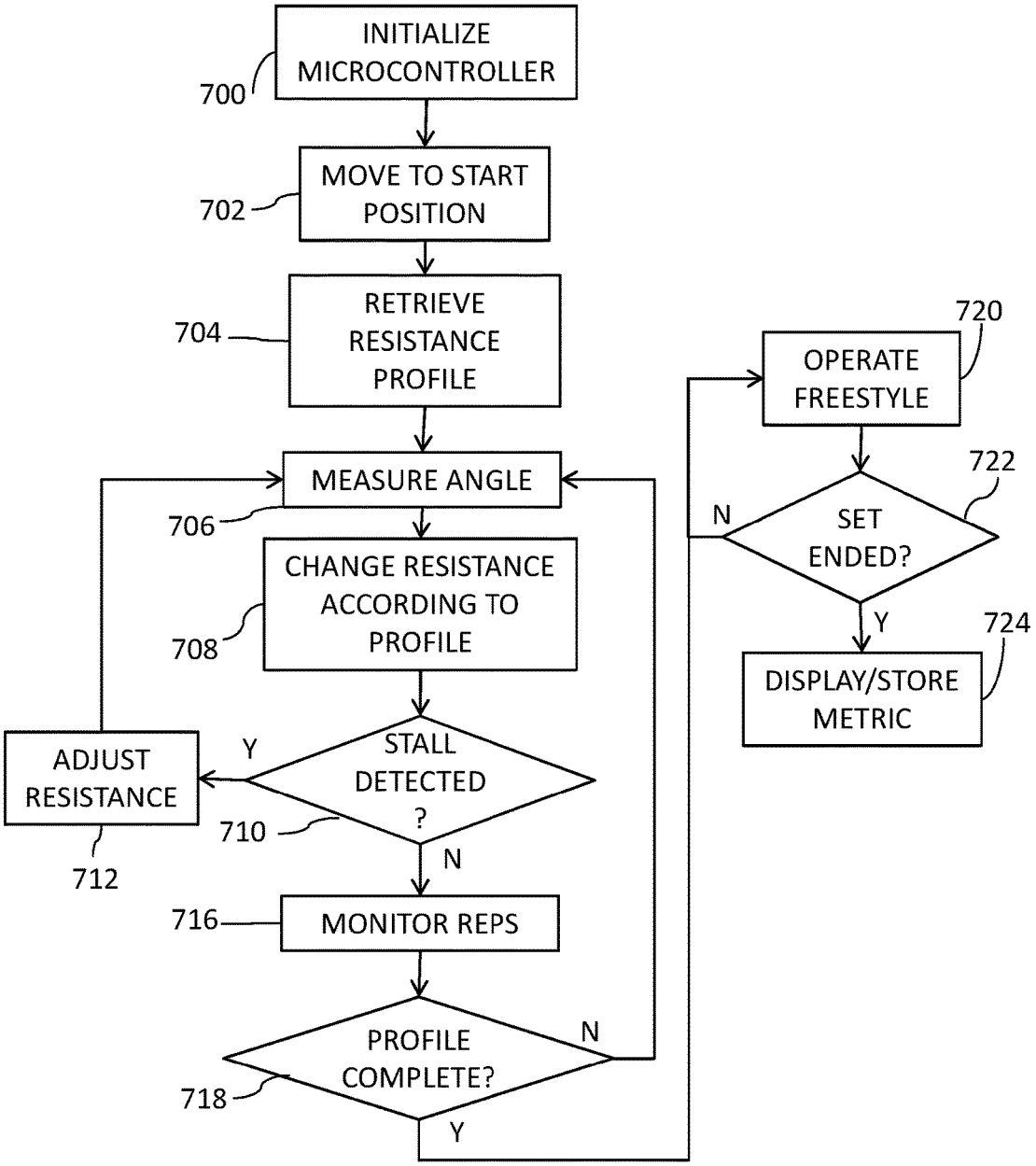
FIG. 20 is a possible logic flowchart depicting operations performed by the electronic control system for implementing a resistance profile.

FIG. 20 depicts a possible sequence of instructions that may be implemented by the microcontroller 510. At operation 700, the microcontroller may be initialized. At operation 702, a voltage may be applied to the actuator 116 to position the cable guide 120 to a starting position. For example, the cable guide 120 may be positioned in a mid-range position that is approximately in the middle of the fully extended and the fully retracted position.

At operation 704, a resistance profile may be read from memory or entered by the user. The resistance profile may include a period of increasing resistance. The resistance profile may include a period of constant resistance. The resistance profile may include a period of adaptive resistance based on performance of the user. The resistance profile may be defined for a predetermined number of exercise cycles. In various examples, the resistance profile may be expressed as a resistance torque profile based on time, repetition, and/or lift angle. The resistance profile may provide a target resistance torque during an exercise session. At operation 706, the angle of the variable resistance cam 102 may be measured by sampling the signal from angular position sensor 134. At operation 708, the resistance may be changed according the selected profile. The present resistance torque may be compared to the target resistance torque and the actuator 116 may be controlled to drive the resistance torque to the target resistance torque. For example, the microcontroller 510 may command a voltage signal to the actuator 116 to extend or retract the cable guide 120 based on the deviation between the desired resistance and the present resistance. The cable guide 120 may be controlled to a position that is derived from the resistance profile. For example, the actuator 116 may be controlled to maintain a constant torque moment during the range of motion of the variable resistance cam 102. The cable guide 120 may be pivoted as the lift angle changes to cause a constant torque moment about the pivot axis.

At operation 710, conditions for a stall condition may be checked. For example, stall detection operations from FIG. 19 may be performed to determine if the variable resistance cam 102 has stalled during a lift operation. If a stall condition is detected, operation 712 is performed. At operation 712, the resistance is adjusted to compensate for the stall condition. The target resistance torque may be decreased in response to a stall condition. For example, the actuator 116 may be controlled to cause the cable guide 120 to reduce the radial distance to the axis of rotation by a predetermined amount to reduce the resistance. The cable guide 120 may remain in the reduced radius position until motion of the weight stack 128 resumes (e.g., the lift angle begins increasing again).

If no stall condition is present, then operation 716 may be performed. Operation 716 may monitor the number of exercise cycles and store the number in memory for later use. At operation 718, a check may be performed to determine if the profile has been completed. If the profile is not completed, the sequence of operations starting with operation 706 may be repeated. If the profile is completed, operation 720 may be executed. At operation 720, the machine may be operated in a freestyle mode that may be similar to that described in FIG. 19. At operation 722, a check is made to determine is the exercise session is ended. For example, the measured angle may be checked to determine if the variable resistance cam 102 is in the resting position for more than a predetermined time. If the set has not ended, operation 720 may be repeated. If the set has ended, operation 724 may be executed to compute, display and/or store the various metrics from the exercise session.

Figure 21:
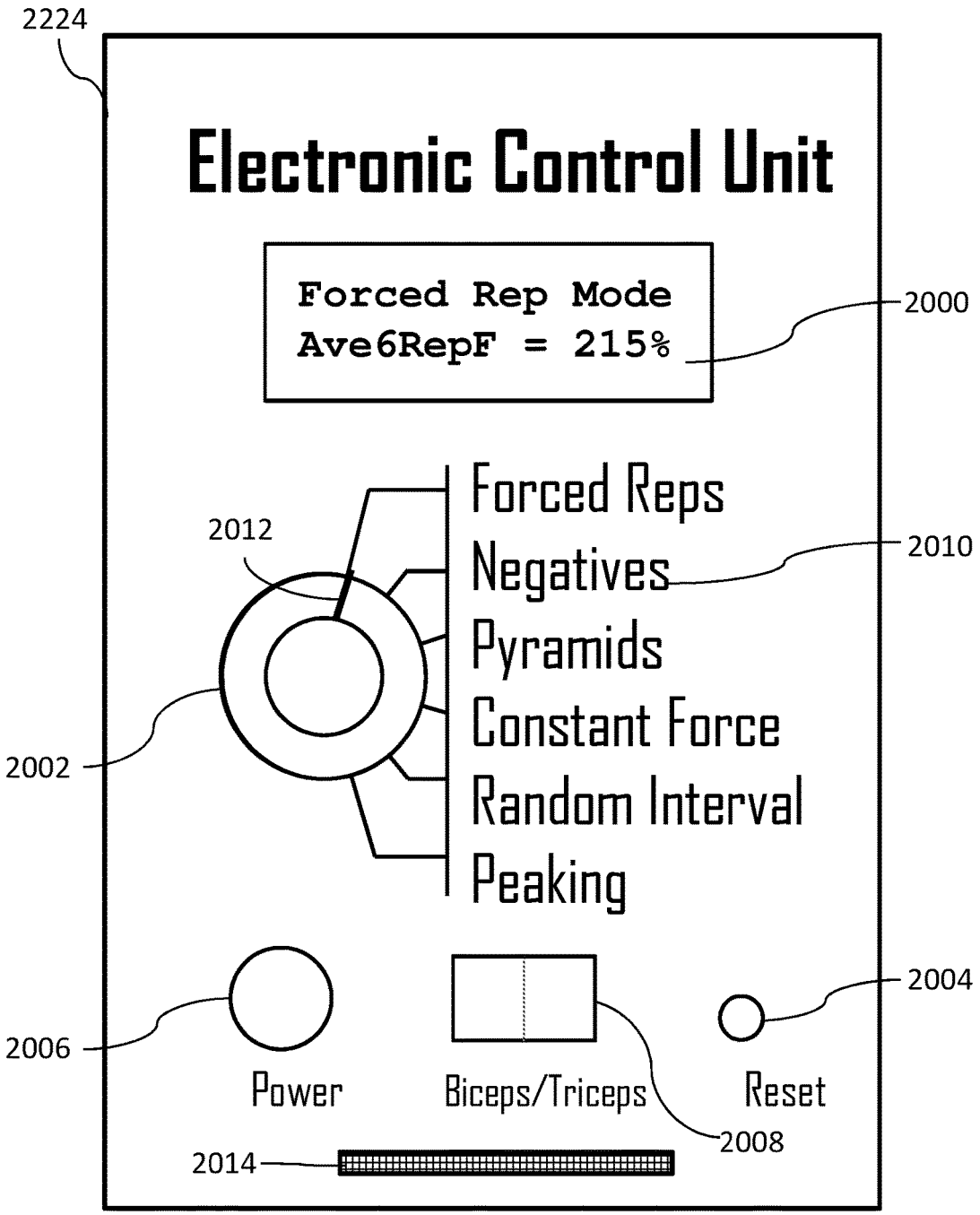
FIG. 21 is a possible user interface configuration.

FIG. 21 depicts a possible configuration for a user interface 2224. The user interface 2224 may include a display 2000. For example, the display 2000 may be a liquid crystal display (LCD). The user interface 2224 may include a rotary switch 2002. The rotary switch 2002 may be configured to have a plurality of discrete positions. Each of the positions may be used to indicate a particular exercise profile. The outputs of the rotary switch 2002 may be coupled to the microcontroller 510. The user interface 2224 may include a label 2010 that describes each of the positions of the rotary switch 2002. For example, the rotary switch 2002 may have six distinct positions. The label 2010 may be placed adjacent to the rotary switch and have an indicator for the switch position along with a textual or graphical description of the switch position. For example, the positions may be described as "Forced Reps", "Negatives", "Pyramids", "Constant Force", "Random Interval", and "Peaking". In addition, a switch cover may include a selection marker 2012 to indicate the selection position of the rotary switch 2002.

The user interface 2224 may include a power button 2006 or switch. The power button 2006 may be configured to turn the apparatus on and off. The user interface 2224 may include a reset button 2004 or switch. The reset button 2004 may be configured to reset the electronic modules to a default state. The user interface 2224 may include a selection switch 2008. For example, the selection switch 2008 may be configured to select between "Biceps" and "Triceps" mode of operation. The selection switch 2008 may be electrically coupled to the microcontroller 510. The microcontroller 510 may monitor the selection switch 2008 and operate the exercise apparatus in the selected mode of operation.

The user interface 2224 may include an audio output device 2014 that is configured to provide audio signals for the user. The audio output device 2014 may be a speaker, a chime, and/or a buzzer. The microcontroller 510 may be electrically coupled to the audio output device 2014. The ECU 500 may include circuitry to interface with the audio output device 2014. The microcontroller 510 may be programmed to output signals to the audio output device 2014.

Figure 22:
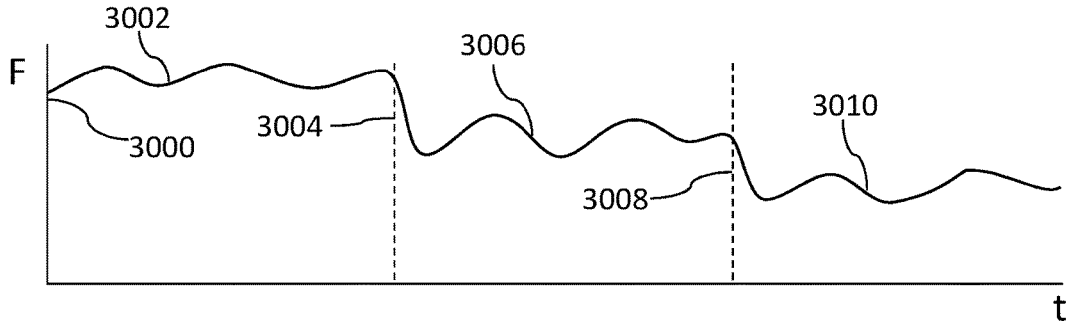
FIG. 22 is a force versus time profile for a forced repetition profile selection.

The exercise apparatus may operate according to a selected exercise profile as selected by the rotary switch 2002. The exercise profiles may be managed and controlled by the microcontroller 310. The microcontroller 510 may be programmed to implement instructions for implementing each of the exercise profiles to be described. FIG. 22 depicts a graph of force versus time for a forced repetitions exercise profile 3000. The forced repetition mode may define a starting resistance. The ECU 500 may monitor the operator performance during the exercise cycle. In the event a stall condition is detected, the ECU 500 may decrease the resistance to allow more repetitions to be completed. During an exercise cycle, each time a stall event is detected, the resistance may be decreased. For example, when a stall event is detected, the cable guide 120 may be commanded to retract to decrease the resistance. For example, the ECU 500 initially commands the exercise apparatus to provide the starting resistance which results in a first force profile 3002. A first user stall event 3004 may be detected. After the first user stall 3004, the exercise apparatus is commanded to a second resistance level which results in a second force profile 3006. After a second user stall event 3008 is detected, the exercise apparatus is commanded to a third resistance level which results in a third force profile 3010.

Figure 23:
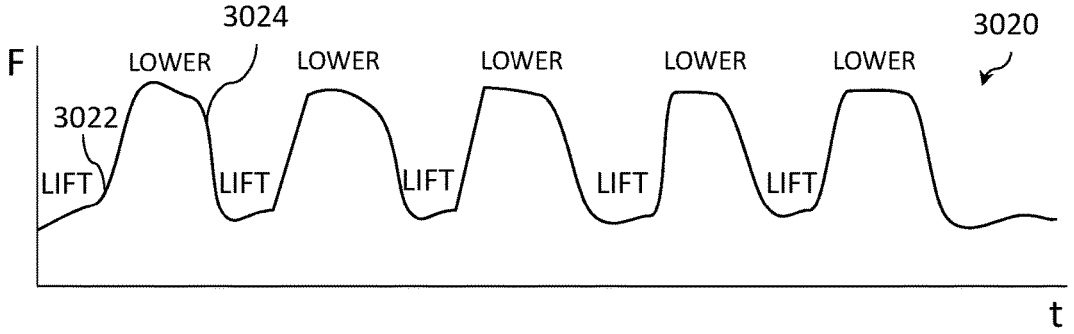
FIG. 23 is a force versus time profile for a negative profile selection.

FIG. 23 depicts a graph of force versus time for a negative exercise profile 3020. The negative exercise profile may be characterized by an increase in resistance during the downward motion of the cable guide 120. During a first phase in which the cable guide 120 is rising, the ECU 500 may command a lift resistance profile which results in a lift force profile 3022. As the cable guide 120 begins to descend, the ECU 500 may command a descent resistance profile which results in a descent force profile 3024. During the lift resistance profile, the cable guide 120 may be in a retracted position. During the lift portion, the cable guide 120 may be extended at a first rate. As the cable guide 120 approaches or reaches a peak angle, the resistance may be increased at a second rate that is greater than the first rate. For example, the lift phase may be defined as the interval when the angular position sensor indicates rotation of the telescoping pivot arm more than a first predetermined angle away from a starting position and toward a peak position. During the descent profile, the cable guide 120 may start in an extended position. As the cable guide 120 descends and approaches a final resting position, the resistance may be decreased. The descent phase may be defined as the interval when the angular position sensor indicates rotation of the telescoping pivot more than a second predetermined angle away from the peak position and toward the starting position. The negative profile may be configured to provide more resistance during the descent phase than during the lift phase.

Figure 24:
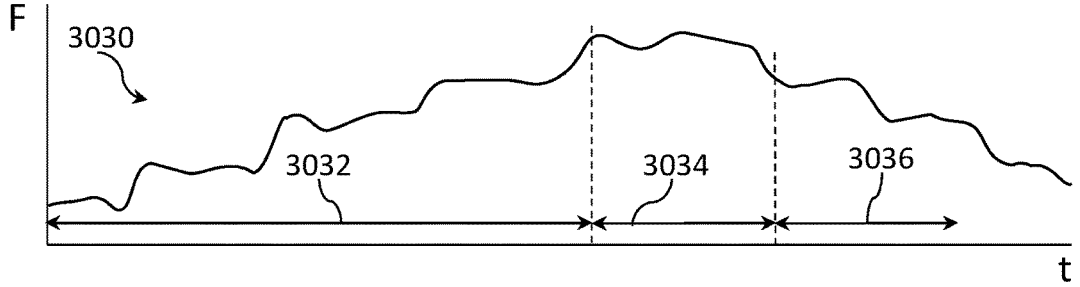
FIG. 24 is a force versus time profile for a pyramids profile selection.

FIG. 24 depicts a graph of force versus time for a pyramids exercise profile 3030. The pyramids profile may be characterized by an increase in resistance over a number of repetitions followed by a decrease in resistance as the end of the exercise cycle approaches. The ECU 500 may command an increasing resistance during an increase segment 3032 of the exercise cycle. The ECU 500 may monitor the angle of the cable guide 120 to determine when a repetition is completed. For each repetition during the increase segment 3032, the resistance may be increased by a predetermined amount. The predetermined amount may be selectable by the operator. After a predetermined number of repetitions, the ECU 500 may command a constant peak resistance during a peak segment 3034. In some cases, the peak segment 3034 may be one repetition. After completion of the peak segment 3034, the ECU 500 may command a decreasing resistance profile during a decrease segment 3036. During the decrease segment 3036, the ECU 500 may command a decrease in resistance after each repetition. The general profile may resemble a pyramid. The ECU 500 commands the actuator travel arm to retract and extend to achieve the desired resistance during the profile. In some configurations, the ECU 500 may be programmed to execute this profile based solely on the time from the start of the lift.

Figure 25:
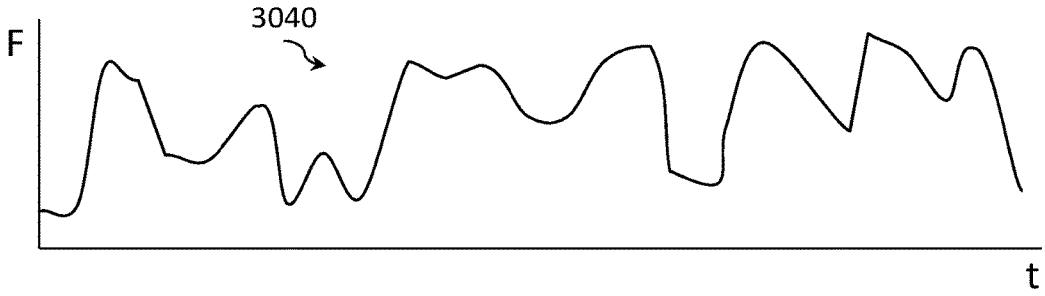
FIG. 25 is a force versus time profile for a random intervals profile selection.

FIG. 25 depicts a graph of force versus time for a random interval exercise profile 3040. The random interval profile may be characterized by a randomly selected resistance for each repetition. The ECU 500 may command a resistance that changes for each repetition. The commanded resistance may be determined from a random number generator implemented by the ECU 500 and may be constrained to be within a predetermined range. The predetermined range may be user selectable to ensure resistance values within the capabilities of the user. In addition, stall event detection may be enabled to prevent stall conditions. Further, during the random interval profile, stall events may be used to detect the maximum resistance that may be commanded. In this manner, resistance values may be commanded that do not cause a stall event allowing the user to perform more repetitions.

Figure 26:
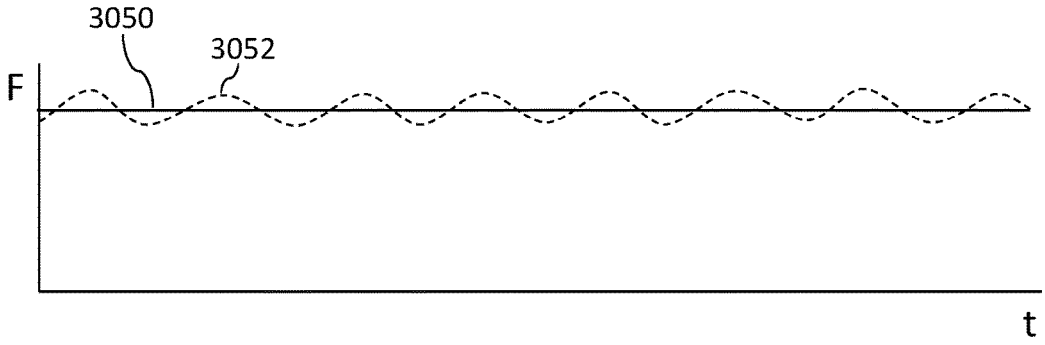
FIG. 26 is a force versus time profile for a constant force load profile selection.

FIG. 26 depicts a graph of force versus time for a constant force exercise profile. The resistance may be commanded to a constant resistance 3050 that results in a load profile 3052. As there may be variation in the moment as a non-circular, eccentric cam rotates about the pivot axis, the ECU 500 may continually adjust the cable guide 120 to deliver a truly constant force resistance. The constant force profile provides a predetermined resistance. The predetermined resistance may be user selectable. In addition, stall event detection may be active during the constant force profile.

Figure 27:
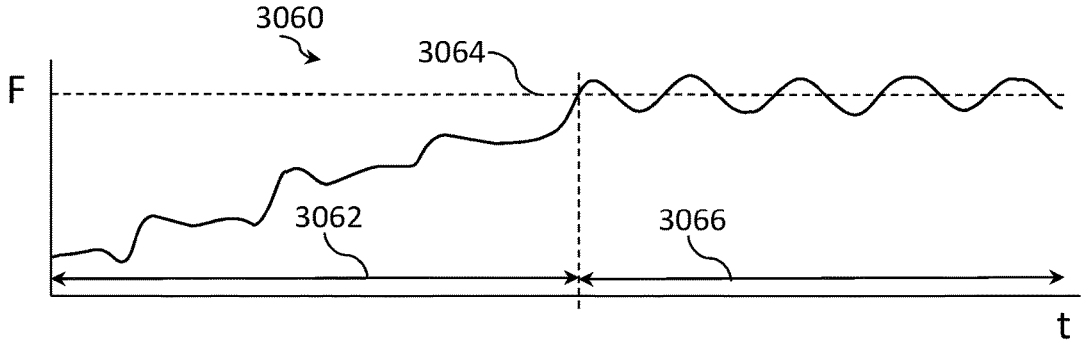
FIG. 27 is a force versus time profile for a weight selection mode.

Additional modes of operation may include dynamic rehabilitation load profiles. Such profiles may be beneficial for aiding patients that are rehabilitating from injury or surgery. FIG. 27 depicts a graph of force versus time for a weight selection exercise profile 3060. A weight selection mode may be configured to provide a reasonable resistance capability for the user. The ECU 500 may be programmed to implement a weight selection mode that is configured to increase the resistance for each repetition until a weight capability of the user is reached.

The ECU 500 may be programmed to compute an angular velocity of the variable resistance cam 102 based on a rate of change of the angular position measurement. Assuming that the angle increases during the lift phase, the angular velocity may be expected to be positive during the lift phase. Assuming that the angle decreases during a descent phase, the angular velocity may be expected to be negative during the descent phase. During the lift phase, the magnitude of the angular velocity may be referred to as the lift speed. During the descent phase, the magnitude of the angular velocity may be referred to as the descent speed.

The weight capability may be ascertained by monitoring various signals. The ECU 500 may be programmed to evaluate a lift speed condition that compares the lift speed to a predetermined threshold. The lift speed being greater than the predetermined threshold may be indicative that the user can reasonably handle additional resistance. The lift speed being less than or equal to the predetermined threshold may be indicative that a weight limit for the user has been reached.

The ECU 500 may also be programmed to evaluate a descent speed condition that compares the descent speed to a predetermined threshold. The descent speed being greater than the predetermined threshold may be indicative that the user is having difficulty exercising at the present resistance. The descent speed being less than or equal to the predetermined threshold may be indicative that the user can continue at the present resistance.

In some configurations, electromyography (EMG) may be incorporated into the exercise. For example, leads from an electromyograph may be connected to a user of the exercise apparatus. The electromyograph may be configured to provide a signal to the ECU 500 indicative of a contraction of a muscle. The ECU 500 may include an interface (e.g., hardware and software) to receive a signal (e.g., EMG signal) from the electromyograph. The signal may correlate to the amount of resistance applied during an exercise cycle. For example, the signal may increase in magnitude as the resistance increases during an exercise session. The ECU 500 may be programmed to evaluate an EMG condition that compares the EMG signal to a predetermined threshold. The EMG signal being less than a predetermined threshold during a repetition may be indicative that the user can reasonably handle additional resistance. The EMG signal being greater than or equal to the predetermined threshold may be indicative that the weight limit for the user has been reached.

In some configurations, a heart rate sensor may be incorporated into the exercise. The heart rate sensor may be configured to provide a signal to the ECU 500 indicative of the heart rate of the operator. The ECU 500 may include an interface (e.g., hardware and software) to receive the signal from the heart rate sensor. The ECU 500 may be programmed to evaluate a heart rate signal condition that compares the heart rate signal to a predetermined threshold. The heart rate being less than a predetermined rate during a repetition may be indicative that the user can handle additional resistance. The heart rate signal being greater than or equal to the predetermined rate may be indicative that the weight limit for the user has been reached.

Note that the basic operation of the exercise apparatus may utilize the lift speed and descent speed conditions. In some configurations, one or more of the heart rate sensor and the EMG may be absent. In such configurations, the lift speed condition may be utilized as the lift speed may be determined from the angle sensor.

If the lift and/or descent speed signals, the EMG signal, or the heart rate signal are indicative of the user being able to reasonably handle additional resistance, the resistance may be increased for subsequent repetitions. In configurations in which one or more of the signals are absent, the absent signal may be excluded from the evaluation. If the lift and/or descent speed signals, the EMG signal, and the heart rate signal are all indicative of a weight limit being reached, the present resistance value may be stored and indicated to the user. For example, the weight limit may be displayed via the user interface 324.

FIG. 27 depicts a graph of force versus time for a weight selection profile 3060. The weight selection mode may include a weight increase phase 3062. When one or more of the EMG signal, the lift speed signal, the descent speed signal, and the heart rate signal are indicative that the user can handle additional resistance; the ECU 500 may operate in the weight increase phase 3062. During the weight increase phase 3062, the resistance may be periodically increased. For example, the resistance may be increased by a predetermined amount every 5 seconds until an appropriate weight is selected. The weight limit for the user may be detected when the EMG signal, the lift speed signal, the descent speed signal, and the heart signal are all indicative that the user weight limit has been reached. When the weight limit is detected, the ECU 500 may operate in with a constant resistance (e.g., a constant resistance phase 3066) that is the weight limit value 3064. Upon detecting the weight limit, the ECU 500 may store the weight limit and output the weight limit value to the user interface 324 for display to the user.

Figure 28:
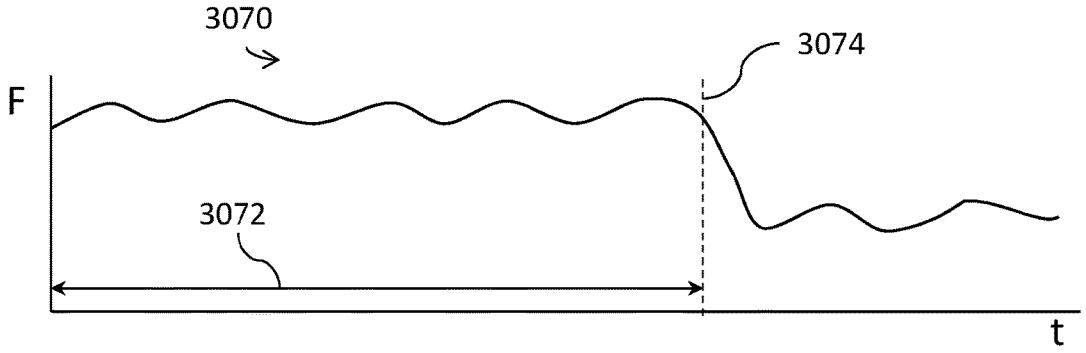
FIG. 28 is a force versus time profile for a rehabilitation mode.

FIG. 28 depicts a graph of force versus time for a rehabilitation mode profile 3070. In the rehabilitation mode, the ECU 500 may initially operate in a fixed resistance mode 3072 in which a constant resistance is commanded. The constant resistance may be the weight limit value as determined in the weight selection mode. In some configurations, the weight selection mode may be performed immediately prior to the rehabilitation mode such that when the weight limit value is determined the system transitions immediately to the rehabilitation mode.

The rehabilitation mode may operate in the fixed resistance mode 3072 until conditions are detected that are indicative of the user being unable to continue at the constant resistance or weight limit value. At a detected time 3074 at which conditions are detected indicative of the user needing assistance, intervention may be taken to assist the user. In this example, the resistance may be decreased by a predetermined amount to facilitate continuation of the exercise cycle.

Various conditions may be monitored to detect when the user is in need of assistance. The ECU 500 may be programmed to evaluate a descent speed condition that compares the descent speed to a predetermined threshold. The descent speed being greater than the predetermined threshold may be indicative that the user is having difficulty exercising at the present resistance. The descent speed being less than or equal to the predetermined threshold may be indicative that the user can continue at the present resistance.

The ECU 500 may be programmed to evaluate a lift speed condition. The lift speed being approximately zero may be indicative that the user is having difficulty exercising at the present resistance. This may be similar to a stall condition. The lift speed condition may be further conditioned on the angular position to ensure that the low lift speed is not at the peak position or rest position of the repetition.

The ECU 500 may be programmed to evaluate a range of motion angle condition. The ECU 500 may monitor the lift angle and determine a range of motion defined by a maximum angle and a minimum angle achieved during each repetition. The range of motion may be expressed as a difference between the maximum angle and the minimum angle. A baseline range of motion may be determined and stored during the weight selection mode of operation. The range of motion being less than a predetermined range may be indicative that the user is having difficulty exercising at the present resistance.

The ECU 500 may be programmed to evaluate an EMG condition. The EMG sensor value being greater than a predetermined value may be indicative of the user being unable to lift the present resistance. The ECU 500 may be programmed to evaluate a heart rate sensor condition. The heart rate sensor being greater than a predetermined value may be that the user is having difficulty exercising at the present resistance.

In some configurations, a heart rate sensor may be incorporated into the exercise. The heart rate sensor may be configured to provide a signal to the ECU 500 indicative of the heart rate of the operator. The ECU 500 may include an interface (e.g., hardware and software) to receive the signal from the heart rate sensor. The ECU 500 may be programmed to evaluate a heart rate signal condition that compares the heart rate signal to a predetermined threshold. The heart rate being less than a predetermined rate during a repetition may be indicative that the user can handle additional resistance. The heart rate signal being greater than or equal to the predetermined rate may be indicative that the weight limit for the user has been reached.

When a condition arises that is indicative of the user being unable to lift the present resistance, the ECU 500 may be programmed to reduce the resistance by a predetermined amount. In addition, an indication may be provided that the condition is present. For example, the ECU 500 may be programmed to generate an audible sound such as a chime through the audio output device 2014. In addition, the ECU 500 may display a message to the user via the display 2000.

The variable resistance cam-based weight machines described provide several benefits to users. The direct coupling of structural components provides better feel to users as a more direct connection to the weight is established. The ability to dynamically vary the resistance provides additional exercise options to maintain user interest and encourage exercise. In addition, the ability to detect a stall during lifting and reduce the resistance permits additional repetitions and may help to prevent injury. The ability to provide continuous value performance metrics also helps users to better evaluate progress over time. The modes of operation described allow the user to continue exercising beyond initial exhaustion for maximum growth.

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A cam mechanism comprising:

a disk configured to attach to an exercise apparatus and configured to rotate about an axis;

a cable guide coupled to the disk and defining a path for a cable and a radial tangent distance between the cable and the axis;

one or more actuators coupled to the disk and the cable guide and configured to move the cable guide relative to the disk to change the radial tangent distance; and a controller programmed to operate the one or more actuators to cause the one or more actuators to move the cable guide to change the radial tangent distance during rotation about the axis thereby changing a force transferred through the cam mechanism.

2. The cam mechanism of claim 1 wherein the cable guide is coupled to the disk through a rotating pivot joint and operating the one or more actuators causes the cable guide to pivot at the rotating pivot joint.

3. The cam mechanism of claim 1 wherein the one or more actuators includes two actuators positioned on opposite sides of the disk and coupled together through an opening defined by the disk.

4. The cam mechanism of claim 1 wherein the one or more actuators includes two actuators that are positioned on a same side of the disk and attached to the cable guide at different locations.

5. The cam mechanism of claim 1 wherein the cable guide is coupled to the disk by a sliding guide that constrains the cable guide to linear motion, wherein the sliding guide includes a first tube coupled to the disk and a second tube that is coupled to the cable guide and mounted concentric to the first tube.

6. The cam mechanism of claim 1 further including a sensor configured to output a signal indicative of an angular position of the disk about the axis.

7. The cam mechanism of claim 6 wherein the controller is further programmed to operate the one or more actuators based on the signal.

8. The cam mechanism of claim 1 wherein the cable guide comprises a plurality of independent sections that are coupled to the disk by a separate one of the one or more actuators.

9. A weight training apparatus comprising:

a disk configured to rotate about an axis;

a lift bar coupled to the disk and configured to rotate about the axis;

a cable guide coupled to the disk and defining a path for a cable and a radial tangent distance between the cable and the axis, wherein a first end of the cable is configured to couple to a weight stack and a second end is configured to attach to the cable guide;

one or more actuators coupling the disk to the cable guide and configured to move the cable guide relative to the disk to change the radial tangent distance;

a sensor configured to output a signal indicative of an angular position of the disk about the axis; and a controller programmed to operate the one or more actuators to cause the one or more actuators to move the cable guide based on the signal to change the radial tangent distance thereby changing a resistance force at the lift bar during rotation of the disk about the axis.

10. The weight training apparatus of claim 9 wherein the cable guide is coupled to the disk through a rotating pivot joint and operating the one or more actuators causes the cable guide to pivot at the rotating pivot joint.

11. The weight training apparatus of claim 9 wherein the one or more actuators includes two actuators positioned on opposite sides of the disk and coupled together through an opening defined by the disk.

12. The weight training apparatus of claim 9 wherein the one or more actuators includes two actuators positioned on a same side of the disk and attached to the cable guide at different locations.

13. The weight training apparatus of claim 9 wherein the cable guide is coupled to the disk by a sliding guide that constrains the cable guide to linear motion, wherein the sliding guide includes a first tube coupled to the disk and a second tube that is mounted concentric to the first tube and coupled to the cable guide.

14. The weight training apparatus of claim 9 wherein the cable guide comprises a plurality of independent sections and each of the independent sections are coupled to the disk through a separate one of the one or more actuators.

15. A weight training apparatus comprising:

a disk configured to rotate about an axis and attach to a weight cable that is coupled to a weight stack;

a cable guide (i) coupled to the disk, (ii) configured to attach to a lift cable that is coupled to a force application member, and (iii) defining a path for the lift cable and a radial tangent distance between the lift cable and the axis;

one or more actuators coupled to the disk and the cable guide and configured to move the cable guide relative to the disk to change the radial tangent distance;

a sensor configured to output a signal indicative of an angular position of the disk about the axis; and a controller programmed to operate the one or more actuators to cause the one or more actuators to move the cable guide based on the signal to change the radial tangent distance thereby changing a resistance force at the force application member during rotation of the disk about the axis.

16. The weight training apparatus of claim 15 wherein the cable guide is coupled to the disk through a rotating pivot joint and operating the one or more actuators causes the cable guide to pivot at the rotating pivot joint.

17. The weight training apparatus of claim 15 wherein the one or more actuators includes two actuators positioned on opposite sides of the disk and coupled together through an opening defined by the disk.

18. The weight training apparatus of claim 15 wherein the one or more actuators includes two actuators positioned on a same side of the disk and attached to the cable guide at different locations.

19. The weight training apparatus of claim 15 wherein the cable guide is coupled to the disk by a sliding guide that constrains the cable guide to linear motion, wherein the sliding guide includes a first tube coupled to the disk and a second tube that is mounted concentric to the first tube and coupled to the cable guide.

20. The weight training apparatus of claim 15 wherein the cable guide comprises a plurality of independent sections and each of the independent sections are coupled to the disk through a separate one of the one or more actuators.

* * * * *